US005642878A

United States Patent [19]

Smithe et al.

[11] Patent Number: 5,642,878

[45] Date of Patent: Jul. 1, 1997

[54] METHOD AND APPARATUS FOR SEPARATING SHEETS FED FROM THE BOTTOM OF A STACK

[75] Inventors: Eliot S. Smithe, Duncansville; Stephen M. Wagner, Ashville, both of Pa.

[73] Assignee: F. L. Smithe Machine Company, Inc., Duncansville, Pa.

[21] Appl. No.: 434,770

[22] Filed: May 4, 1995

[51] Int. Cl.[6] ..... B65H 3/06; B65H 5/08; B65H 3/12; B65H 3/14

[52] U.S. Cl. ..... 271/109; 271/14; 271/94; 271/95; 271/98

[58] Field of Search ..... 271/94, 96, 99, 271/108, 95, 98, 106

[56] References Cited

U.S. PATENT DOCUMENTS

| | | | |
|---|---|---|---|
| Re. 32,128 | 4/1986 | Blumle | 271/94 |
| 999,936 | 8/1911 | Wines . | |
| 1,312,539 | 8/1919 | Harrold . | |
| 1,771,652 | 7/1930 | Novick . | |
| 1,804,476 | 5/1931 | Novick . | |
| 2,241,474 | 5/1941 | Novick | 271/1 |
| 2,425,936 | 8/1947 | Hepp | 271/11 |
| 2,799,497 | 7/1957 | Novick | 271/2 |
| 2,954,224 | 9/1960 | Novick | 271/1 |
| 3,141,667 | 7/1964 | Novick | 271/74 |
| 3,160,081 | 12/1964 | Novick | 93/62 |
| 3,265,383 | 8/1966 | Shute | 271/11 |
| 3,380,353 | 4/1968 | Mittermayer | 93/61 |
| 3,385,593 | 5/1968 | Snellman | 271/11 |
| 3,405,935 | 10/1968 | MacNeill | 271/11 |
| 3,599,970 | 8/1971 | Smithe et al. | 271/29 |
| 3,655,181 | 4/1972 | Paulson | 271/29 |
| 3,674,255 | 7/1972 | Arnell | 271/29 |
| 3,790,163 | 2/1974 | Helm | 271/165 |
| 3,861,667 | 1/1975 | Jahme | 271/11 |
| 3,998,449 | 12/1976 | Hornung | 271/112 |
| 4,052,050 | 10/1977 | Carter | 271/18.3 |
| 4,194,442 | 3/1980 | Martelli | 93/53 SD |
| 4,320,893 | 3/1982 | Mle . | |
| 4,542,894 | 9/1985 | Feldkamper et al. | 271/11 |
| 4,681,311 | 7/1987 | Sardella | 271/11 |
| 5,028,043 | 7/1991 | Karolyi | 271/14 |
| 5,028,044 | 7/1991 | Fischer | 271/91 |
| 5,511,772 | 4/1996 | Ganz et al. | 271/95 |

FOREIGN PATENT DOCUMENTS

| | | | |
|---|---|---|---|
| 0361259 | 4/1990 | European Pat. Off. | 271/98 |
| 3644035 | 6/1988 | Germany | 271/94 |
| 0332828 | 9/1989 | Germany | 271/95 |

*Primary Examiner*—William E. Terrell
*Assistant Examiner*—Richard Chandler
*Attorney, Agent, or Firm*—Price & Adams

[57] ABSTRACT

A stack of sheets or blanks for feeding one by one from the bottom of the stack by a feeding mechanism is supported for high speed feeding to subsequent stations. A feed cylinder rotatably supported beneath the leading edge of the stack includes a suction device. An intermediate portion of the blank leading edge is drawn by the suction device downwardly toward an opening in the periphery of the feed cylinder. Continued rotation of the feed cylinder further bends the blank. For blanks of large size and having a leading edge with an irregular contour the blank leading edge intermediate portion extends forwardly from edge lateral portions. Positioned in spaced relation along the interior of the feed cylinder are a plurality of air manifolds having outlets directed at selected angles upon the lateral portions of the blank leading edge. The manifolds are connected to a source of pressurized air which is directed in a sweeping motion upon the blank leading edge lateral portions upon rotation of the feed cylinder. The pressurized air flow sequentially bends the blank leading edge lateral portions downwardly away from the stack as the feed cylinder rotates to move the compressed air outlets into closer proximity to the edge lateral portions. A rotating sweep of compressed air downwardly bends the blank lateral edge portions to positively control the movement of the blank to separate completely from the stack before the blank is removed to assure jam-free feeding at high speed.

20 Claims, 13 Drawing Sheets

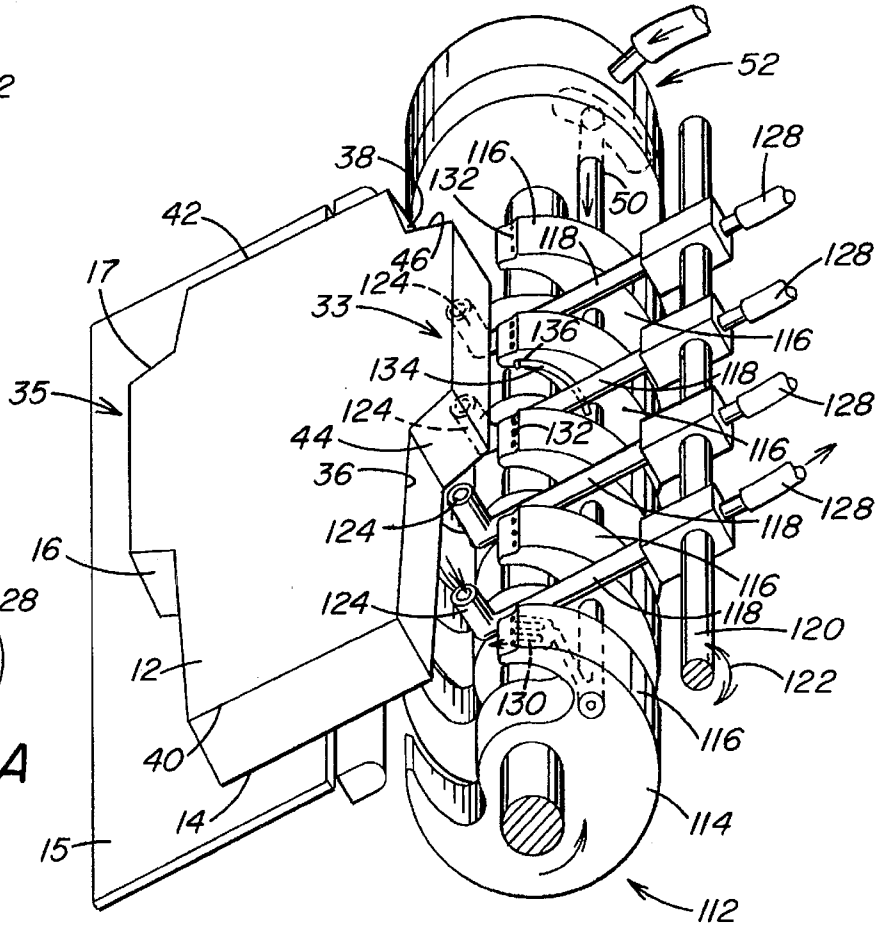
FIG. 14
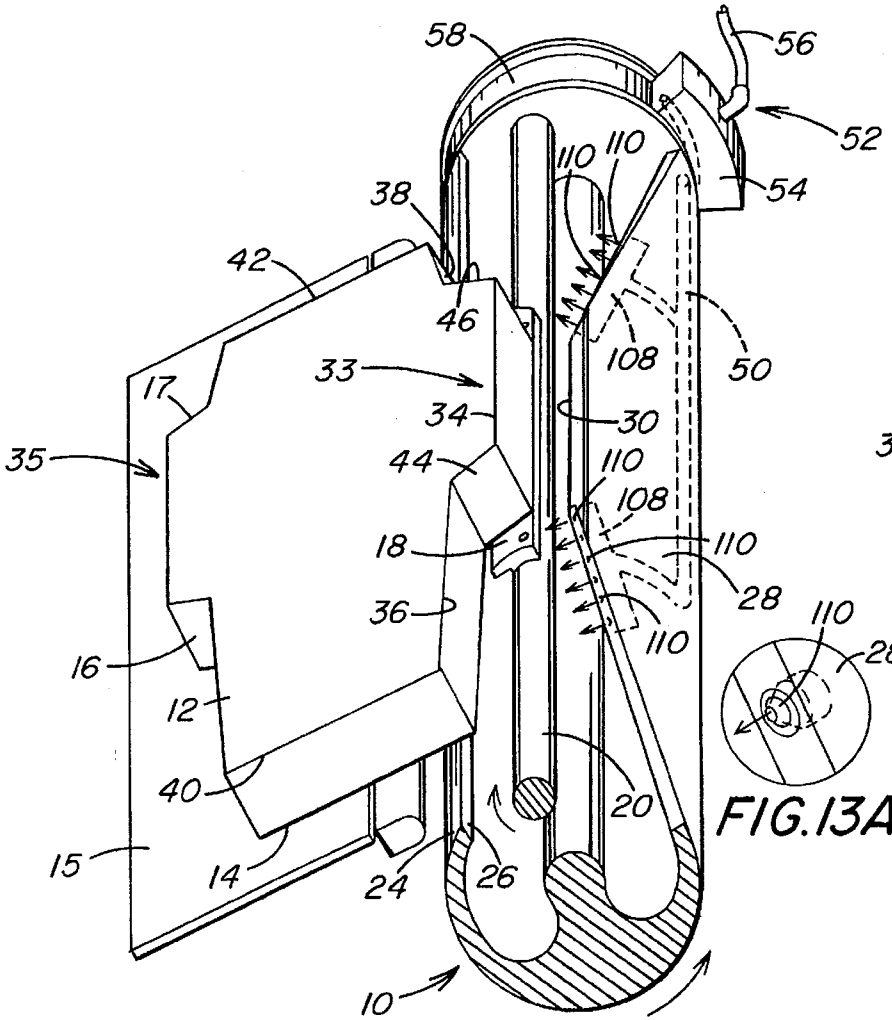
FIG. 13
FIG. 13A

METHOD AND APPARATUS FOR SEPARATING SHEETS FED FROM THE BOTTOM OF A STACK

BACKGROUND OF THE INVENTION

1. Field of the Invention

This invention relates to method and apparatus for separating from a stack blank sheets of material supported to retain in a preselected position the stack and feeding the sheets one by one from the bottom of the stack and, more particularly, to apparatus for controlling the separation of each blank from the bottom of the stack to assure that the blank is in proper position to be pulled forwardly from the bottom of the stack.

2. Description of the Prior Art

It is well known in sheet feeding operations to feed sheets of blank material one by one from a stack supported by a rigid member adjacent to the surface of a sheet feeding cylinder. The sheet feeding operation is applicable to a wide variety of sheet-like materials that include photographic film, corrugated blanks for making boxes, folded newspapers, envelope blanks, and the like. The feeder devices are generally classified as top-sheet feeders and bottom-sheet feeders.

In a top-sheet feeder the uppermost or top sheet is removed from a stack by the feeder mechanism and serially conveyed to other devices, for example, a film sheet feeder as disclosed in U.S. Pat. No. 3,265,383. In a bottom-sheet feeder the lowermost sheet is removed from the stack by the feeder mechanism and conveyed serially to other devices. U.S. Pat. Nos. 3,599,970; 3,790,163; and U.S. Pat. No. 3,998,449 disclose feeding envelope blanks from the bottom of a stack in an envelope machine.

As disclosed in U.S. Pat. No. 3,599,970 envelope blanks fed from the bottom of a stack to a conveyor form a band of overlapped envelope blanks. The stack of envelope blanks rests on rotary supporting and separating discs. A feeder removes the blanks from the stack by a sucker shaft which separates the lowermost blank from the stack so that the blank may be removed from the stack and transferred to the surface of a rotating cylinder or to a series of conveyor belts as disclosed in U.S. Pat. Nos. 2,241,474; 2,954,224; 3,141,667; and U.S. Pat. No. 3,160,081. With this type of feeder a feed cylinder is located adjacent to the bottom of the leading edge of the stack in a position to receive the blanks and move them downwardly away from the stack.

In combination with a feed cylinder it is known to mount a suction picker for oscillation through a path clear of the cylinder. The blanks are advanced along the path by the cylinder. One or more deflectors pivotally mounted relative to the front edge of the bottom of the stack move at an angle to the direction of picker travel to push each blank clear of the picker and into conformity with the surface of the cylinder.

To initiate separation of the lowermost blank from the stack the picker is pivoted into position to engage the forward or leading edge of the lowermost blank. Upon application of suction or vacuum to the nozzle of the picker, the lowermost blank leading edge is bent or deflected downwardly away from the stack. The leading edge of the lowermost blank moves downwardly upon downward movement of the picker while the trailing edge of the blank remains fixed. A deflector then moves into position to support the front edge of the stack as the bottom blank continues to bend downwardly and is engaged on the surface of a feed cylinder. Rotation of the feed cylinder carries the bottom blank in a path that removes it from the bottom of the stack.

The known pickers and deflectors for sheet feeding mechanisms are pneumatically and mechanically operable. The picker effects the initial separation of the blank from the bottom of the stack. The deflector is a mechanically movable arm positioned between the initially separated blank and the bottom of the stack to permit the leading edge of the blank to move onto the feed cylinder or into engagement with a series of conveyor belts. The picker and deflector are operated sequentially. When one of them is operating on a blank the other is returned to position for the next operation. This is essential in high speed operations so that when the operation of one blank is commenced the operation of the other blank is still in progress, such as disclosed in the sheet feeding mechanism disclosed in U.S. Pat. No. 1,771,652.

One factor that slows the feeding operation is allowing the picker ample time to exert a vacuum or suction force on the leading edge of the bottom blank so that the leading edge is securely engaged before the picker moves downwardly away from the stack. The actuation of the vacuum force and downward movement of the blank leading edge must be performed rapidly. Then the leading edge must be completely separated from the bottom of the stack so that it is engaged along the entire length of the leading edge by the pressure cylinder. If the separation of the leading edge is incomplete and not positively controlled, then the bottom blank will become jammed between the bottom of the stack and the feed cylinder.

An early approach in paper feeding devices for assuring separation of the forward edge of the bottom blank from a stack before the bottom blank is removed from the stack is disclosed in U.S. Pat. No. 999,936. The stack is supported by counterrotating discs which include cutout portions for exposing during a portion of rotation of the discs the leading edge of the stack. When the cutout portion of the discs is positioned beneath the stack leading edge suction devices are swung into contact with the bottom blank and held there for a period of time to produce sufficient suction to grip the leading edge. When the suction device is swing downwardly the leading edge of the sheet is drawn with it and completely separated from the bottom of the stack.

The suction force upon the leading edge acts for the period of time to permit the forward edge of the bottom blank to be engaged by a feed cylinder. Rotation of the feed cylinder pulls the bottom sheet from the stack. With this arrangement the bottom sheet is not pulled from the stack until the leading edge is completely engaged and positively separated from the bottom of the stack. Thus controlled separation of the leading edge of the bottom sheet is required to prevent jamming in high speed sheet feeders.

Controlled separation of the leading edge of the bottom sheet or blank of a stack is readily accomplished for blanks having a relatively narrow and continuous forward or leading edge, as encountered for example with wallet-size envelopes. For larger size blanks as encountered in making catalog-size envelopes or envelope blanks having a contoured leading edge formed by die cutting separation of the leading edge of the blank is more difficult to control. Many sheet feeders are designed to feed blanks of a fixed dimension; however, sheet feeders have been proposed to accommodate blanks of different sizes. For example, U.S. Pat. Nos. 1,808,706 and 2,799,497 disclose sheet feeders having provision for lateral adjustment to act upon stacks of blanks of different size to assure positive and controlled separation of the bottom blank before it is removed from the stack.

Another approach to providing sheet feeders operable to accommodate a range of blank sizes are feeders having segmented feed cylinders with suction devices positioned along the length of the cylinder between the segments, as disclosed in U.S. Pat. Nos. 1,312,529 and 2,425,936. It has also been proposed by the prior art devices to utilize pressurized air in combination with suction or vacuum to assure complete separation of the bottom blank from the stack to prevent jamming in the feeding operation.

U.S. Pat. No. 1,804,476 discloses feeding blanks from the top of a stack where suction rolls pull the blank upwardly away from the stack. Then a blast of air blows the separated blank against a pair of rotating cylinders which transfer the blank to a conveyor mechanism.

In U.S. Pat. No. 3,380,353 a sheet feeder for envelope blanks includes pivotal blower heads positioned above the feed cylinder opposite the leading edge of the stack. Air blasts are discharged from the blower heads downwardly toward the upper surface of the bottom blank that has been bent downwardly by a sucker head. At the time when the air blast is applied from blower heads, the suction in the sucker head is relieved so that the downwardly diverted air may bend the blank past the sucker head and into position to be engaged by the feed cylinder.

A combination of suction or vacuum force and pressurized air utilized in a sheet feeding apparatus for printing machines and the like is disclosed in U.S. Pat. No. 3,385,593. Air under pressure is directed upon the bottom sheets in a stack to provide a cushion support. This relieves the weight of the stack from the bottom sheets to facilitate separation of the sheets from the bottom of the stack during feeding. The air is supplied externally above the feed cylinder directed downwardly upon the forward edge of the bottom sheets of the stack.

U.S. Pat. No. 3,655,181 discloses a printing press feeder including a nozzle connected to a source of pressurized air directed toward the bottom of the stack. A jet of air is directed between a feed drum and a transfer roller opposite the front edge of the bottom of the stack to assure that only one piece of paper at a time is transferred to the feed drum from the bottom of the stack.

In U.S. Pat. No. 3,674,255 an air blast is used in a sheet feeding device to facilitate separating the trailing edge of a sheet from the feed or suction roller after the sheet has been removed from the bottom of a stack and transferred to the suction roller. This arrangement is intended to prevent tearing of the sheet as it is conveyed by the suction roller from the stack.

U.S. Pat. No. 3,405,935 discloses a mechanism for separating IBM punch cards from one another in a stacked arrangement by feeding the cards from the bottom of a stack on a vacuum belt. To prevent the two cards from being conveyed at once because the vacuum acting on the lowermost card can be transmitted through the punched holes to the card above, the lowermost card is subject to atmospheric air. With this arrangement an air cushion is created between the lowermost and second lowermost cards.

In U.S. Pat. No. 4,052,050 labels are removed from the bottom of a stack by a rotating picker in which the leading edge of the label is engaged by a vacuum created on the surface of the picker and then is transferred onto the surface of a feed roll with the assistance of a jet of air supplied through a tube positioned above and externally of the picker. U.S. Pat. Nos. 3,861,667; 4,194,442; 4,320,893; 4,542,894; 4,681,311; 5,028,043; and U.S. Pat. No. 5,028,044 are further examples of more recent developments in sheet feeding operations where blanks are fed at high speed one by one from the bottom of a stack.

While a number of prior art devices have proposed improvements to sheet feeding mechanisms to assure positive separation of the bottom sheet from a stack in high speed feeding operations, the prior art devices have not provided an acceptable solution to high speed feeding of stacked blanks having an extended leading edge with an irregular contour. With the prior art devices described above the leading edge of the blank is relatively narrow, particularly for blanks used to make wallet-size envelopes or blanks having a diamond shape configuration and relatively narrow in width. The known devices satisfactorily initiate separation of the bottom blank from the stack where the width of the blank corresponds in length to the length of the sucker shaft or even in a larger blank having a leading edge which is free of any contour or die cut irregularity. This is not the case for large blanks, such as those used to make catalog-size envelopes or envelopes having a center seam or a side seam where a portion of the leading edge is die cut. With a blank having a die cut leading edge the intermediate portion thereof extends or leads the lateral portions of the leading edge. In other words, the lateral portions of the leading edge are recessed or displaced rearwardly from the intermediate portion of the leading edge.

The problems encountered in feeding from the bottom of a stack blanks having die cut leading edges is that the intermediate portion is initially engaged by the sucker shaft of the feed cylinder disclosed in U.S. Pat. No. 3,599,970, and the lateral portions of the leading edge lag behind. For large size blanks used in making center seam or side seam envelopes the recessed lateral portions can have a length almost as great as the leading edge intermediate portion. Consequentially the lateral portions of the leading edge do not follow the intermediate portion when the intermediate portion is first engaged by the sucker shaft. The lateral portions being positioned rearwardly of the leading edge are not subject to the suction force acting on the intermediate portion.

The leading edge intermediate portion is deflected downwardly and effectively separated from the bottom of the stack, but the leading edge lateral portions are uncontrolled and may still remain in contact with the bottom of the stack when the feed cylinder begins to remove the bottom blank from the stack. As the blank is bent downwardly by the sucker bar and engaged by the feed cylinder the remaining portions of the blank, which have yet to be engaged by the sucker bar, follow a different feed path which may result in jamming of the bottom sheet, especially as operating speed increases.

Therefore there is need in high speed sheet feeding of large size blank material and particularly large center seam and side seam envelope blanks for a mechanism to positively control movement of the contoured lateral front edge of the blank to assure that the leading edge is evenly separated from the bottom of the stack before the blank is fed from the stack.

SUMMARY OF THE INVENTION

In accordance with the present invention there is provided apparatus for separating blanks from the bottom of a stack that includes a stack supporting member for retaining in a preselected position a stack of individual blanks. A feed cylinder is rotatably positioned partially beneath the front edge of a stack. The feed cylinder has a peripheral opening. A suction separating mechanism is positioned adjacent to the peripheral opening of the feed cylinder. The suction separating mechanism has suction ports extending beyond the peripheral opening of the feed cylinder for applying a suction force on a lower surface of a bottom blank of the stack to deflect an intermediate portion of a front edge of the bottom blank downwardly into the cylinder peripheral opening during a portion of rotation of the feed cylinder. Means in the rotating feed cylinder engage an upper surface of the bottom blank adjacent to the deflected edge thereof and further bend the bottom blank front edge downwardly while a rearward edge of the blank remains fixed relative to the stack. A source of air under pressure is directed from inside the feed cylinder outwardly through the peripheral opening into contact with a lateral portion of the front edge of the bottom blank as the feed cylinder rotates to urge the blank front edge lateral portion downwardly in a path following the movement of the blank front edge intermediate portion to provide complete and evenly controlled separation of the bottom blank from the stack.

Further in accordance with the present invention there is provided a method for separating blanks from the bottom of a stack that includes supporting a stack of blanks to be fed one by one from the bottom of the stack. A feed cylinder is rotatably supported adjacent to and beneath a front edge of the stack. An intermediate portion of a front edge of a bottom blank is deflected from the stack while maintaining a rearward edge of the bottom blank fixed relative to the stack. The blank front edge intermediate portion is bent downwardly into a peripheral opening of the rotating feed cylinder. A stream of pressurized air is directed from within the feed cylinder outwardly through the peripheral opening thereof into contact with a lateral portion of the blank front edge as the feed cylinder rotates. The front edge lateral portion is urged downwardly in a path following the movement of the intermediate portion of the blank front edge to obtain complete and controlled separation of the bottom blank from the stack.

In addition the present invention is directed to a feed cylinder for engaging blanks separated from the bottom of a stack of blanks that includes a cylinder rotatably positioned adjacent to and beneath a front edge of the stack of blanks. The cylinder has a peripheral surface with a longitudinal surface therein. Suction devices are movably positioned adjacent to the longitudinal opening for applying a suction force adjacent to the cylinder peripheral surface upon a lower surface of an intermediate portion of a front edge of a bottom blank of the stack to bend the blank front edge intermediate portion downwardly into the opening. A pressurized stream of air emanates from within the cylinder and is directed outwardly through the opening upon a lateral portion of the bottom blank front edge to bend the front edge lateral portion to follow the direction of movement of the front edge intermediate portion for complete and controlled separation of the bottom blank from the stack.

Accordingly, a principal object of the present invention is to provide method and apparatus for feeding blank sheet material from the bottom of the stack where the leading edge of the blank is completely separated from the bottom of the stack and the movement of the leading edge is controlled for positive engagement with a feed cylinder before the blank is removed from the stack.

Another object of the present invention is to provide in an envelope making machine a sheet feeding mechanism for separating envelope blanks having an irregularly contoured leading edge one by one from the bottom of the stack in a controlled manner to prevent jamming of the blank due to uncontrolled movement of the lateral portions of the leading edge of the blank, especially in high speed feed operations.

A further object of the present invention is to provide a method for feeding large size envelope blanks having a die cut leading edge from the bottom of a stack where the lateral portions of the leading edge are controlled as the forwardly extending intermediate portion of the leading edge is engaged on the surface of a feed cylinder to assure complete separation of the blank from the bottom of the stack before it is removed therefrom.

An additional object of the present invention is to provide a feed cylinder in a blank feeding mechanism for an envelope machine where a source of pressurized air is directed from within the cylinder outwardly through the periphery thereof to impact the lateral leading edge portions of the blank to assure that the blank is completely separated from the stack and follows the bending movement of the intermediate portion of the blank engaged by a sucker shaft of the feed cylinder.

These and other objects of the present invention will be more completely disclosed and described in the following specification, the accompanying drawings, and the appended claims.

BRIEF DESCRIPTION OF THE DRAWINGS

FIGS. 13 and 13A are schematic isometric views of a further embodiment of the present invention, illustrating in array of nozzles extending from an air manifold positioned within the periphery the feed cylinder for directing a stream of pressurized air upon the lateral portions of the front edge of the bottom blank for controlled separation of the bottom blank from the stack.

FIG. 14 is a schematic isometric view of a further embodiment of the present invention, illustrating a segmented feed cylinder featuring two sources of pressurized air within the feed cylinder, one including an array of nozzles in segmented fingers and another including an air hose extending outwardly from within the feed cylinder.

DESCRIPTION OF THE PREFERRED EMBODIMENTS

Figure 1:
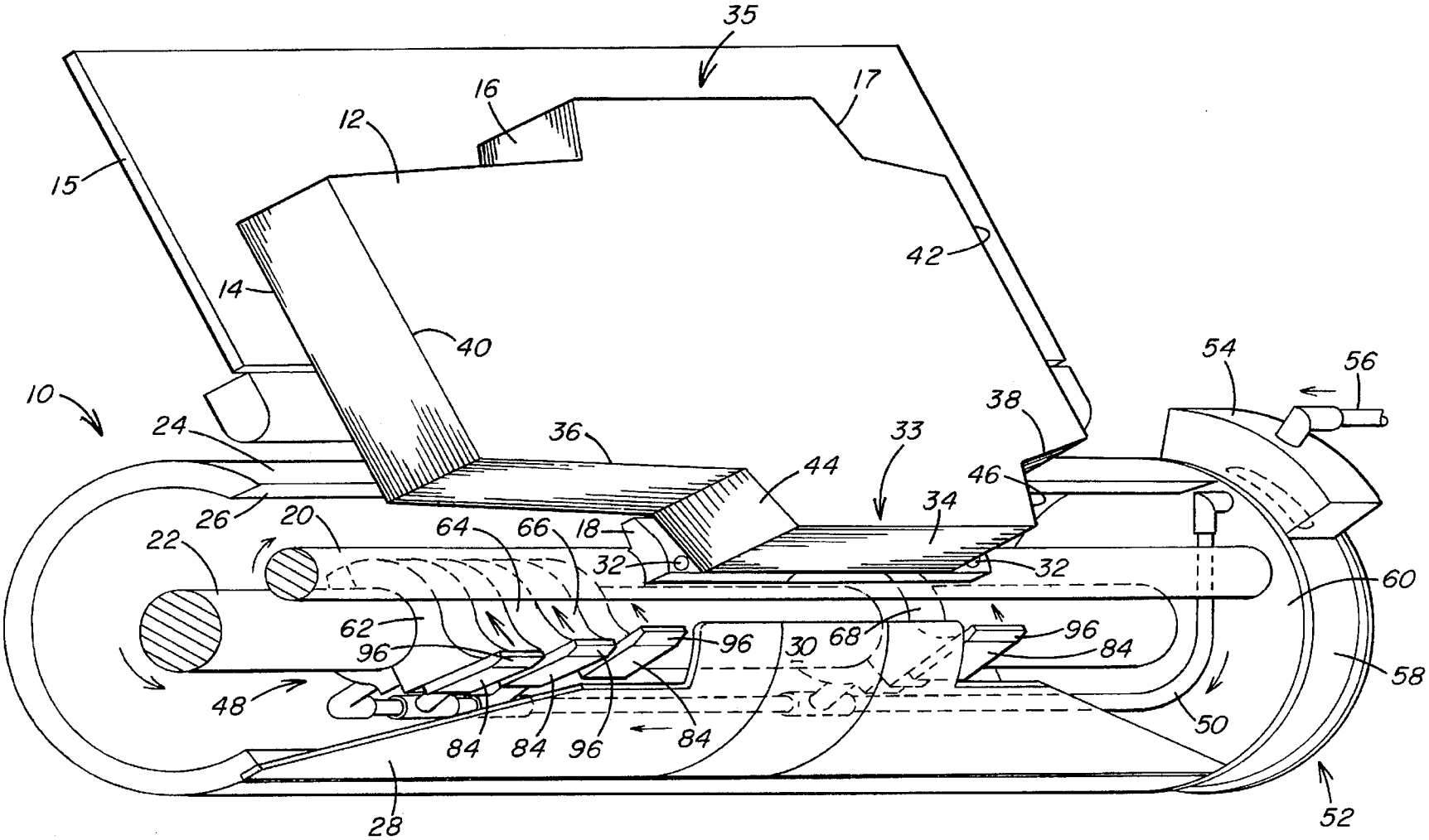
FIG. 1 is a schematic isometric view of a feed cylinder of a sheet feeding mechanism, illustrating a stack of envelope blanks having an irregularly contoured leading edge acted upon by a combination of suction and pressurized air to effectively control and separate the leading edge of the bottom blank for removal from the stack.
Figure 2:
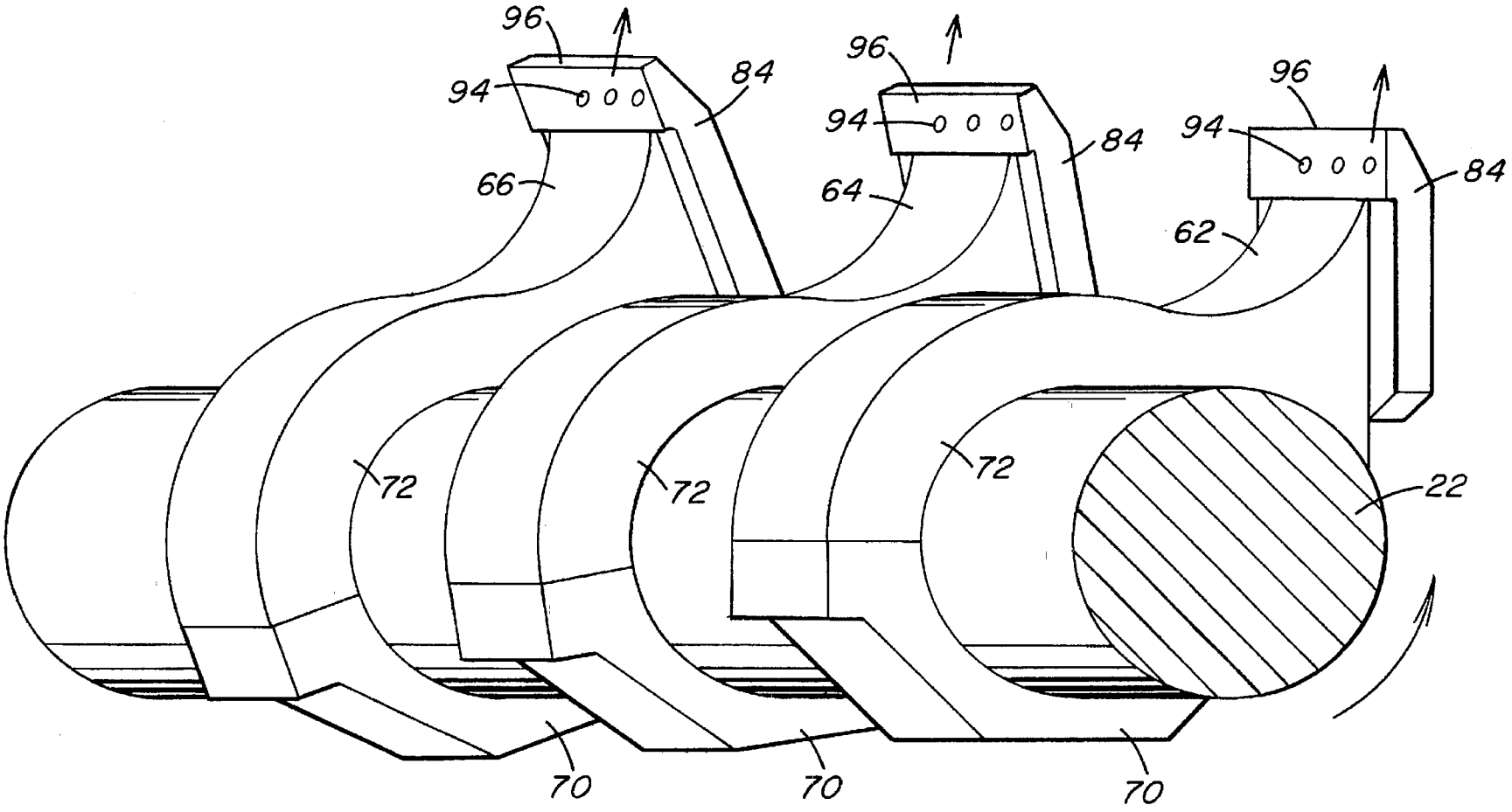
FIG. 2 is a partial sectional, isometric view of a plurality of air nozzles mounted on a rotatable shaft positioned within the feed cylinder shown in FIG. 1.

Referring to the drawings and particularly FIGS. 1 and 2, there is illustrated a feed cylinder generally designated by the numeral 10 positioned adjacent to and partially beneath a stack 12 of individual sheets or blanks 14 of material to be fed one by one from the bottom of the stack by the feed cylinder 10. The feed cylinder 10 is one component of a sheet or blank feeding mechanism incorporated in a manufacturing device for fabricating articles from the individual blanks.

The feed cylinder 10 is adaptable, for example, in a feeder mechanism provided on an envelope making machine in which the individual blanks 14 are used to make envelopes of a variety of sizes and designs. The feed cylinder 10 of the present invention is also adaptable for use in feeder mechanisms that feed other types of sheet material in forming processes, such as cards, film sheet material, corrugated blanks, folded newspaper, multi-sheet material, and the like. Therefore, it should be understood that the feed cylinder 10 of the present invention is not limited to feeding blanks for making envelopes.

The feed cylinder 10, as will be explained further in greater detail, initially separates the bottom blank 14 from the stack 12 and bends the leading edge of the blank downwardly away from the stack 12 and toward the surface of the cylinder 10. The blank leading edge is deflected or bent downwardly until it contacts and engages the surface of the cylinder 10. A suction force at the surface of the cylinder 10 engages the leading edge of the bottom blank 14. The bottom blank is thereafter removed from the bottom of the stack upon continued rotation of the feed cylinder.

Figure 4:
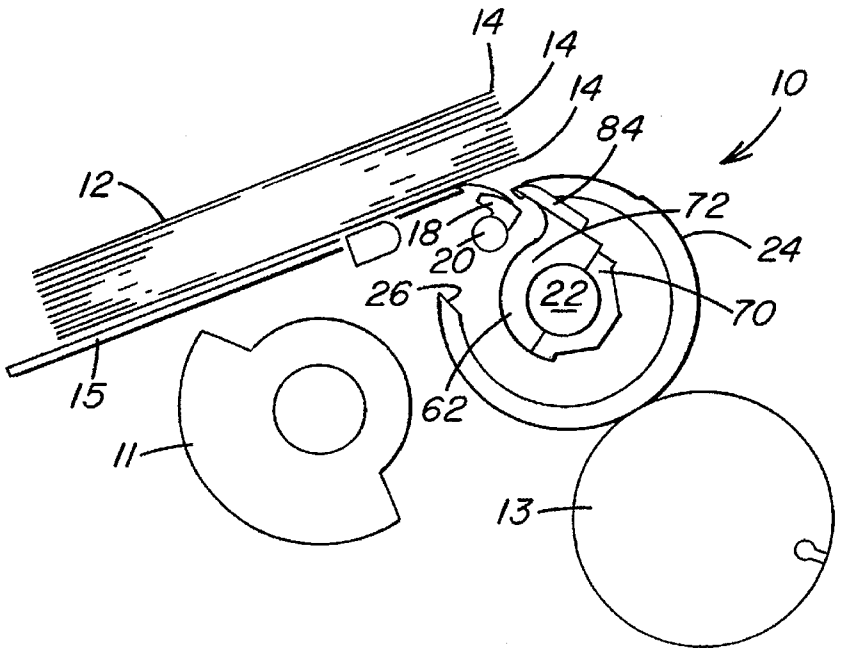
FIG. 4 is a schematic elevational view similar to FIG. 3, illustrating the initial bending of the leading edge of the bottom blank from the stack downwardly by the combined effects of suction air and pressurized air from the feed cylinder.
Figure 3:
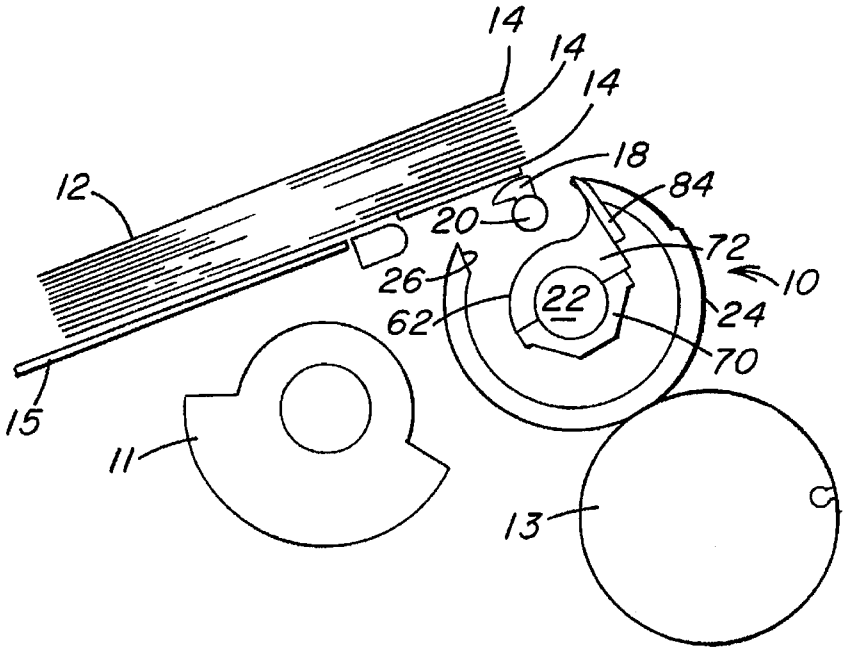
FIG. 3 is a schematic view in side elevation of the sheet feeding mechanism of the present invention, illustrating the stack of envelope blanks before being acted upon by the feed cylinder.

With the blank 14 engaged by a suction force on the surface of the feed cylinder 10, the blank comes in contact with the surface of an adjacently positioned rotating pressure cylinder 11, shown in FIGS. 3 and 4. The pressure cylinder 11 applies pressure to the blank on the feed cylinder 10 to maintain the blank engaged to cylinder 10 thereto. As the feed cylinder continues to rotate the blank is transferred to the surface of a third adjacently positioned cylinder or transfer cylinder 13.

As the blank 14 is transferred from the surface of the feed cylinder 10 to the transfer cylinder 13 the vacuum force applied at the surface of the feed cylinder 10 is interrupted. A vacuum force on the surface of the transfer cylinder 13 is initiated so that the blank is transferred and engaged to the surface of the rotating transfer cylinder 13. From the transfer cylinder 13 the blank is conveyed to subsequent stations, for example, in an envelope making machine for folding the blank and performing other operations on the blank to convert it to a completed envelope. The details of the pressure cylinder 11 and the transfer cylinder 13 that form the feeder mechanism are beyond the scope of the present invention and are disclosed in detail in U.S. Pat. No. 3,599,970 which is incorporated herein by reference.

Figure 11:
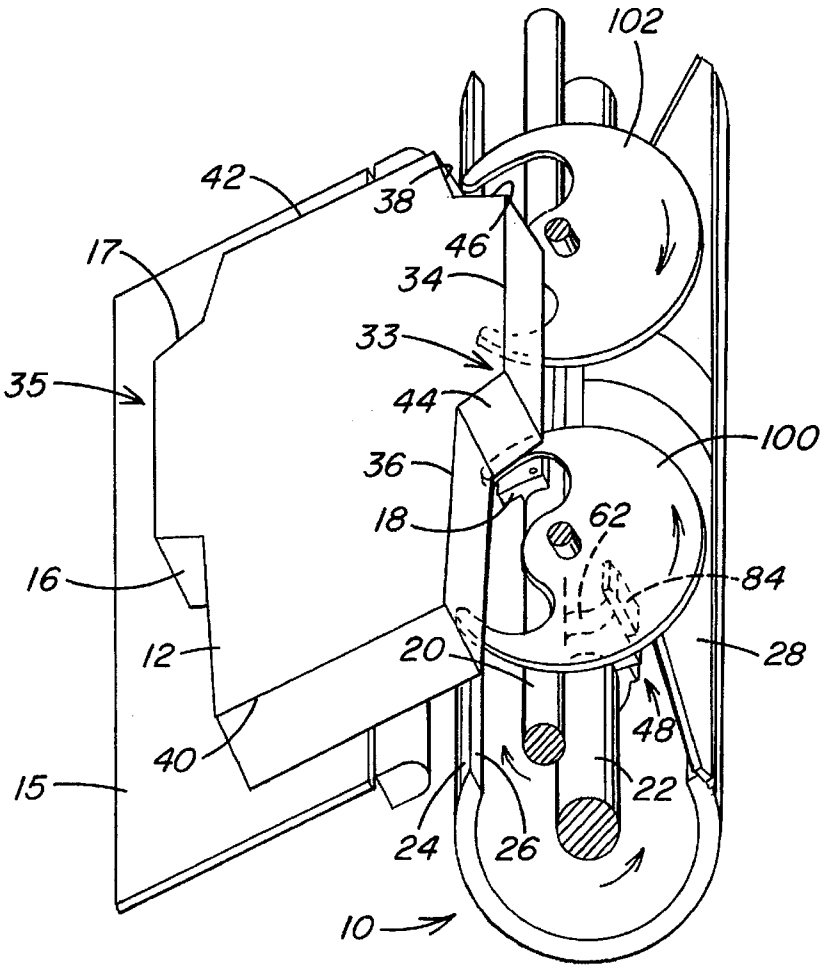
FIG. 11 is a schematic isometric view of one embodiment of the present invention, illustrating a feed cylinder having a pair of rotating discs for supporting the front portion of the stack.

A stack supporting member 15, shown in FIG. 1, is arranged to support a major portion of the stack 12 and includes a pair of upstanding register rods (not shown). Blank recessed portions 16 and 17 at the rearward edge thereof abut the register rods and provide a register reference for feeding of the blanks one by one in the sheet feeding operation. A pair of rotating discs, as shown in the embodiment of the invention illustrated in FIG. 11, is supported in the machine frame in underlying relation with the leading edge of the stack 12. The support discs are counterrotating and include cutout portions or segments which permit protuberances 18 of a sucker shaft 20 to extend upwardly beyond the periphery of the feed cylinder 10 between the cutout portions of the discs to separate and remove the bottom blank 14 from the stack 12. The details of the counterrotating support discs are beyond the scope of the present invention and are described in detail in the incorporated U.S. Pat. No. 3,599,970.

As further disclosed in U.S. Pat. No. 3,599,970 a knife-like support (not shown) is provided to support the leading or front edge of the stack 12 when the bottom blank 14 is withdrawn therefrom by the feed cylinder 10. The support knife includes air nozzles that direct air to the front edge of the stack to separate the front edges of the stack for removal of the individual blanks 14 from the stack 12. When the support knife is moved out of supporting relation with the stack 12 the air supply to the nozzles thereof is cut off. The support knife is connected to a bell crank that is pivoted about a shaft to permit the knife to pivot inwardly beneath the stack of blanks 14 and outwardly away therefrom in timed relation to the other components of the feeding mechanism. The supply of air to the nozzles of the support knife is controlled to supply air only when the support knife is beneath the stack of blanks.

The feed cylinder 10 includes an axial shaft 22 having end portions (not shown) rotatably mounted in a frame. One of the shaft end portions is connect to a drive gear which is in turn connected to a gear train to rotate the feed cylinder 10 in timed relation to the other elements associated with the feeder mechanism.

The feed cylinder 10 has a generally hollow construction and a cylindrical surface 24 having an elongated rectangular opening 26 in the periphery of the surface 24. The opening 26 in the cylinder surface 24 forms opposing edges which extent substantially the length of the cylinder. Secured to one of the edges is a plate 28 that includes a pullout segment 30 that extends in an arcuate path over the cylinder opening 26 in the direction of rotation of the cylinder 10, for example in a counterclockwise direction of rotation as shown in FIG. 1.

A plurality of suction apertures or ports (not shown) are positioned in the periphery of the feed cylinder 10 and extend longitudinally adjacent to the plate 28. Suction is applied from a vacuum device through the ports by means of a conventional segmented valve. A vacuum or suction force is applied to the surface of the feed cylinder 10 when in a preselected angular position relative to the stack 12. The details of the feed cylinder suction ports and segmented valve are also disclosed in U.S. Pat. No. 3,599,970.

The sucker shaft 20 is rotatably mounted in the feed cylinder 10 for rotation in a direction opposite the direction of rotation of the cylinder 10. For example, as shown in FIG. 1 the sucker shaft 20 rotates in a clockwise direction, and the feed cylinder 10 rotates counterclockwise. The sucker shaft 20 is connected to conventional drive gearing that provides for rotation of the shaft 20 relative to the feed cylinder 10. The velocity ratio between the sucker shaft 20 and the feed cylinder 10 is 3:1.

The sucker shaft 20 has one or more protuberances 18 which extend radially from the shaft 20 and along the length thereof. The protuberances 18 are connected through passageways 32 to a vacuum device to supply a suction force through the passageways 32 while the sucker shaft 20 is in a preselected position relative to the stack 12. In this manner a vacuum force is applied to the upper surface of the protuberances 18.

Preferably the protuberances 18 are fabricated from a flexible material, such as urethane polymer, rubber or other deformable and resilient material. To facilitate removal of the bottom blank 14 from the stack 12 the protuberances 18 extend outwardly beyond the peripheral surface 24 of the feed cylinder 10 to a location adjacent the bottom of the stack 12. In this manner the lower or underside surface of the bottom blank 14 is engaged by the sucker shaft 20.

With a 3:1 ratio between the sucker shaft 20 and the cylinder 10, the sucker shaft 20 makes 3 revolutions for each revolution of the feed cylinder 10. With this arrangement the leading edge of the bottom blank 14 is initially separated from the stack 12 by contact with the sucker bar protuberances 18. When the bottom blank front edge contacts the protuberances the suction force adheres the front edge to the protuberances. As the sucker shaft 20 rotates in a clockwise direction the leading edge of the bottom blank 14 is bent downwardly into the opening 26 of the feed cylinder 10. (See FIG. 4). Further rotation of the feed cylinder 10 moves the edge of the pull-out segment 30 into abutting relation with the upper surface of the bottom blank leading edge and bends the blank downwardly away from the stack 12.

With conventionally known feed cylinders for feeding wallet-type and commercial-type envelope blanks into an envelope machine the width of the leading edge of the blank is satisfactorily engaged by the sucker shaft to assure complete separation of the bottom blank of the stack at high speeds without becoming jammed between the stack and the feed cylinder 10. As long as the leading edge of the blank is maintained under control to assure its separation from the bottom of the stack, then removal of the blank from the stack can be accomplished at high speed without jamming. Maintaining control of the blank leading edge becomes more difficult for larger size blanks. Control of the bottom blank leading edge is also a problem when the contour of the leading edge is irregular as for blanks having a die cut leading edge for side seam or center seam envelopes of a catalog size and style that utilize clasps or string ties to close the flap.

If the leading edge of a large size envelope blank is not controlled along its entire length by the sucker shaft to separate it from the bottom of the stack, then the blank will not be effectively separated from the bottom of the stack for removal from the stack. For example as shown in FIG. 1, each blank 14 used to fabricate a side seam or center seam catalog-type envelope includes a leading or forward edge generally designated by the numeral 33 having an intermediate portion 34 and opposite lateral portions 36 and 38. Side edges 40 and 42 of each blank extend between the leading edge 33 and a trailing edge 35. The leading edge 33 has a similar die cut configuration as the trailing edge 35 in which recessed portions 44 and 46 are formed in the leading edge 33. The edge intermediate portion 34 leads or extend forwardly from the lateral portions 36 and 38.

Because of the die cut configuration of the blanks 14 the leading edge intermediate portion 34 is first engaged by the sucker shaft protuberances 18 and is bent downwardly upon rotation of the feed cylinder 10 before the leading edge lateral portions 36 and 38 are engaged. Unless the lateral portions 36 and 38 are bent downwardly and follow the direction of movement of the intermediate portion 34 the blank will not be completely separated from the bottom of the stack when the feed cylinder 10 begins to remove the blank from the stack.

In order to control separation of envelope blanks having a leading edge 33 of an extended length, the present invention utilizes in combination with a suction force applied by the sucker shaft 20 on the leading edge 33 a secondary force that includes a source of air under pressure. In accordance with the present invention pressurized air is directed from inside the feed cylinder 10 outwardly through the peripheral opening 26 into contact with the lateral portions 36 and 38 of the leading edge of the bottom blank 14. The pressurized air is directed in a controlled, sequential pattern upon the edge lateral portions. As the feed cylinder rotates with the leading edge intermediate portion 34 engaged by the sucker shaft 20 the lateral edge portions 36 and 38 follow the movement of the intermediate edge portion 34. In this manner complete and evenly controlled separation of the bottom blank 14 from the stack 12 is accomplished before the bottom blank is removed from the stack.

In the embodiment shown in FIG. 1 the pressurized air originates from an air manifold generally designated by the numeral 48 mounted for rotation with the feed cylinder axial shaft 22. The manifold 48 is secured for rotation with the shaft 22 and is connected by an airline 50 to a stationary valve device generally designated by the numeral 52 having a valve body portion 54 connected by a conduit 56 to a source of pressurized air. The valve device 52 has a valve stator 58 and a valve rotor 60. The valve stator 58 is stationary relative to the feed cylinder 10, and the valve rotor 60 rotates with the feed cylinder 10. Suitable passageways are provided between the valve stator 58 and the valve rotor 60 to supply pressurized air to the air manifold 48 through the airline 50 when the feed cylinder 10 is in a preselected angular position relative to the stack 12.

Figure 15:
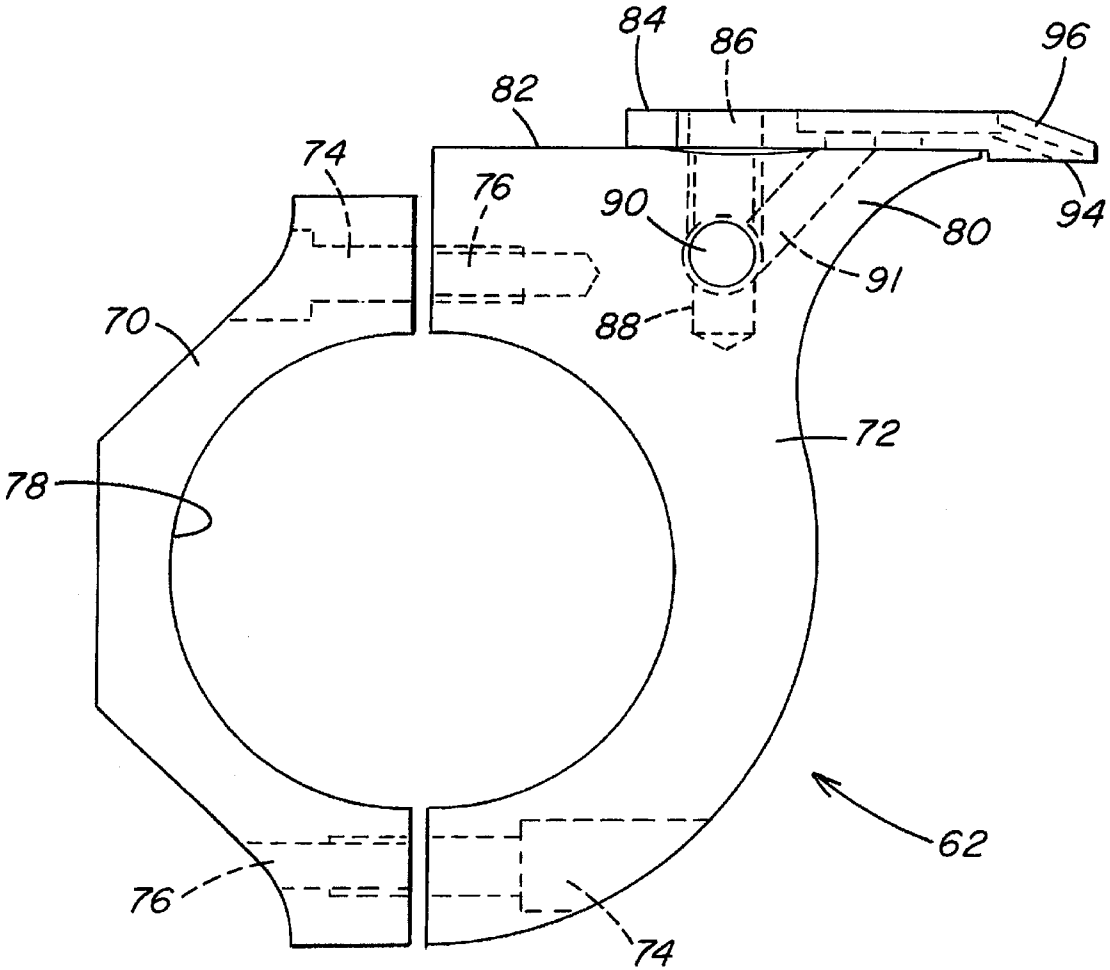
FIG. 15 is a view in side elevation of a bracket for adjustably mounting an air nozzle within the feed cylinder.
Figure 17:
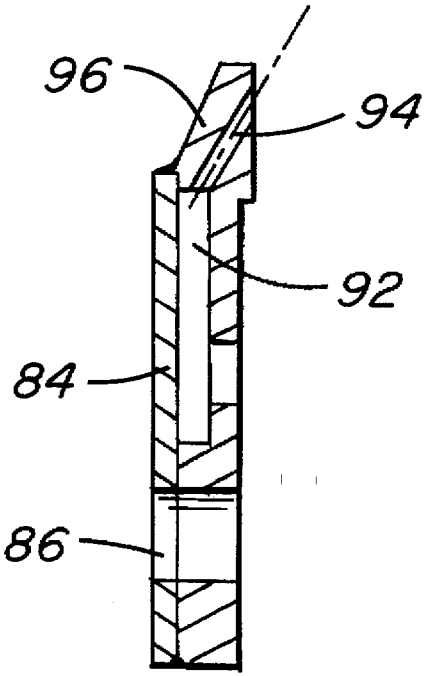
FIG. 17 is a sectional view in side elevation of the air nozzle shown in FIG. 16, illustrating the angular orientation of the nozzle outlets.
Figure 16:
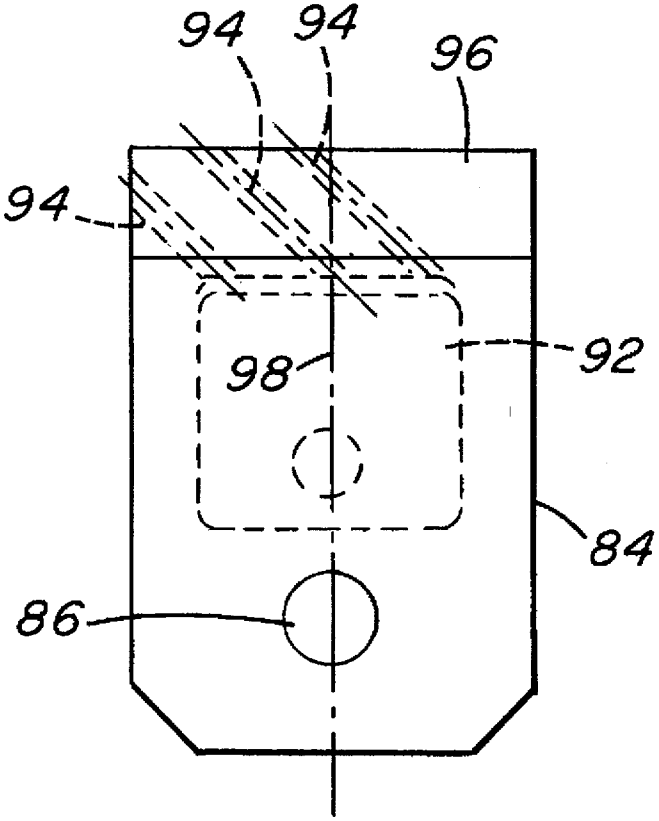
FIG. 16 is a plan view of an air nozzle, illustrating an array of outlets for directing a pressurized stream of air upon the leading edge of the blank.

As seen in FIGS. 1 and 2 and in greater detail in FIGS. 15–17, the air manifold 48 for directing pressurized air onto the lateral portions 36 and 38 of the bottom blank leading edge 33 includes a plurality of brackets 62–68 which are adjustably clamped to the axial shaft 22 of the feed cylinder 10. The brackets 62–68 are positioned at selected locations along the length of the shaft 22 and in selected radial positions on the shaft 22 oppositely of the lateral portions 36 and 38 of the blank leading edge. Based upon the die cut configuration of the blank leading edge the brackets 62–68 are mounted sequentially to direct a stream of pressurized air to those portions of the leading edge which are recessed or lag behind the intermediate portion 34.

As seen in FIG. 1 the intermediate portion 34 of the blank leading edge 33 is not symmetrically positioned with respect to the direction of feed of the blank from the bottom of the stack. The intermediate portion 34 is laterally displaced from the center line of the feed path of the blank from the bottom of the stack. The brackets 62–68, however, are laterally spaced from the center line of the feed path. For the die cut configuration of the blank leading edge 33 illustrated in FIG. 1 three brackets 62–66 are positioned on one side of the leading edge intermediate portion 34 which is adjacent to the operator side of the feeding mechanism. A single bracket 68 is positioned on the opposite side adjacent to the operator side of the feeding mechanism. Based upon the die cut configuration of the blank the brackets are movable to selected positions on the shaft 22.

Each bracket, as illustrated for the bracket 62 shown in detail in FIG. 15, includes a bifurcated body portion having a pair of semicircular sections 70 and 72 that are bolted together through aligned bores 74 and 76. Each bracket section has an arcuate surface which forms a circular opening 78 for receiving the feed cylinder shaft 22 when the bracket sections 70 and 72 are bolted onto the shaft 22. With this arrangement the assembled bracket 62 is rotatable to a desired radial position on shaft 22 to provide control of the angle of the pressurized air stream from within the cylinder 10 outwardly through the peripheral opening 26 on to the blank leading edge 33.

The manifold bracket section 72 has a mounting portion 80 with an upper planar surface 82 for receiving an air nozzle 84. A bolt (not shown) extends through aligned bores 86 and 88 of the nozzle 84 and mounting portion 80 respectively to connect the nozzle 84 to the assembled bracket 62. The bracket mounting portion 80 includes an air inlet 90 that communicates with an air passageway 91 through the mounting portion 80 to an outlet in the mounting surface 82. The air outlet in the mounting surface 82 communicates with a passageway 92 of the nozzle 84, as seen in detail in FIG. 17. The nozzle air passageway 92 communicates with a plurality of nozzle outlets 94 located at a forward tip 96 of the nozzle 84. The air inlet 90 in the bracket mounting portion 80 is connected by a fastener (not shown) to an extension of the airline 50 to supply compressed air to the nozzle outlets 94.

As seen in FIGS. 15 and 16 the nozzle outlets 94 are oriented at a selected angular position in the air nozzle 84. The angular orientation of the outlets 94 is selected based upon the position of the respective nozzle 94 on the feed cylinder shaft 22. The factors to be taken into account as to the angular position of the nozzle outlets 94 include whether the respective nozzle is positioned adjacent the operator side or the drive side of the feeding mechanism and the relative radial position of the nozzle 84 on the shaft 22 with respect to the blank leading edge intermediate portion 34.

Figure 29:
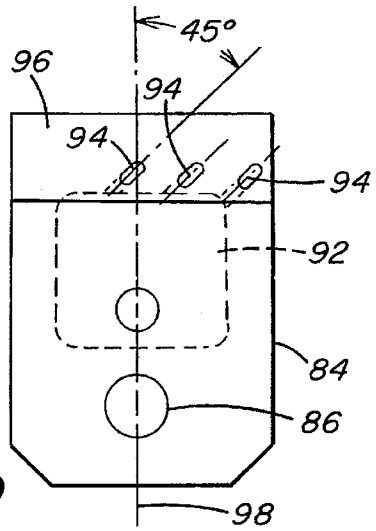
FIGS. 27–29 are plane and elevational views of an air nozzle having air outlets oriented downwardly at a 50° angle.
Figure 32:
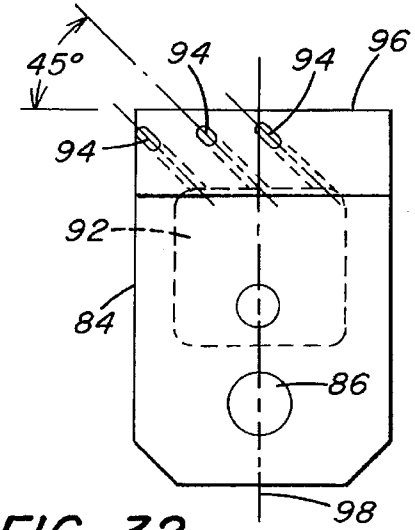
FIGS. 30–32 are views similar to FIGS. 18–20 of an air nozzle having air outlets oriented downwardly at a 20° angle from the horizontal, illustrating the outlets extending at 45° in the opposite direction from the nozzles shown in FIGS. 18–29.
Figure 31:
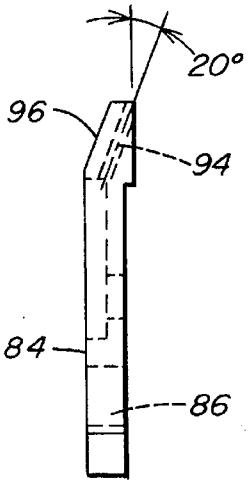
Figure 30:
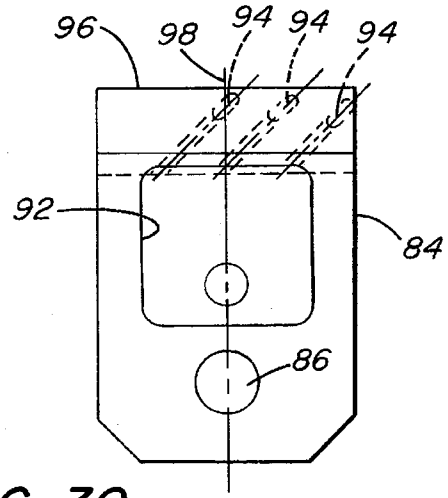

FIGS. 18–29 illustrate four embodiments of an air nozzle 84 for selective positioning adjacent to the operator side of the feeding mechanism. FIGS. 30–32 illustrate one embodiment of the air nozzle 84 for positioning adjacent to the operator side of the feeding mechanism. The position of each embodiment of the air nozzle 84 on the feeder shaft 22 is determined by the angular position of the respective nozzle outlets 94 so that the stream of pressurized air directed in a sequential sweeping pattern onto the blank leading edge lateral portions 36 and 38. The air flow sequential sweeping pattern progressively deflects downwardly the lateral portions from the leading edge intermediate portion outwardly to the side edges 40 and 42 of the blank 14 as the feed cylinder 10 rotates.

Figure 20:
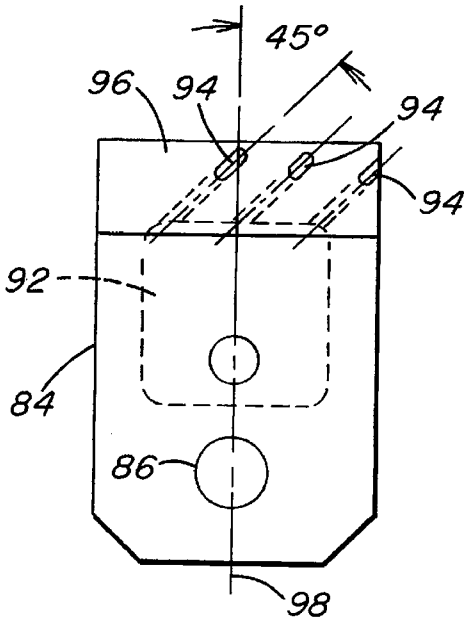
FIGS. 18–20 are plane and elevational views of an air nozzle having air outlets oriented downwardly at a 20° angle.
Figure 19:
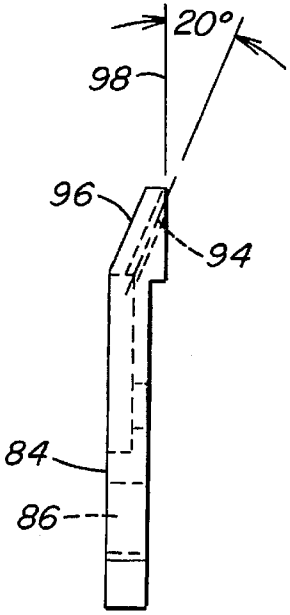
Figure 18:
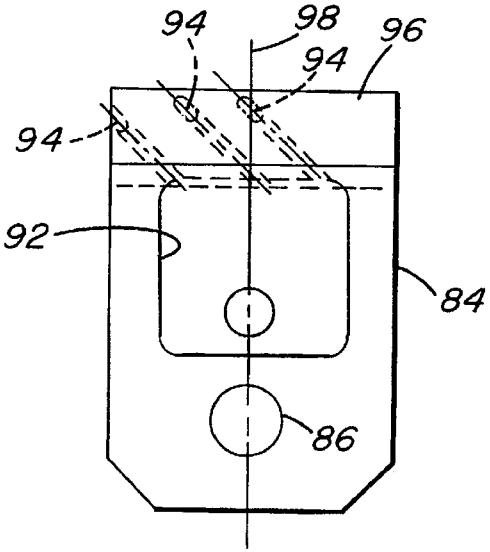

The air nozzle 84 shown in FIGS. 16 and 17, as well as FIGS. 18–20, includes nozzle outlets 94 that are first oriented to extend first at a 45° angle laterally with respect to a longitudinal center line 98 of the nozzle 84. Second, each outlet 94 is pitched downwardly, as seen in FIG. 19, at an angle from the longitudinal center line 98. For each of the air nozzles 84 positioned on the operator side of the feeding mechanism the outlets 94 extend at a 45° angle toward the operator side. In contrast the air nozzles 84 mounted on the shaft 22 adjacent to the drive side extend at a 45° angle toward the drive side of the feeding mechanism.

The 45° lateral orientation of the nozzle outlets 94 is selected to assure that the stream of pressurized air is directed toward the lateral edges 36 and 38 of the envelope blank away from the leading edge intermediate portion 34. The angle at which the nozzle outlets 94 are pitched downwardly from the longitudinal axis 98 is determined by the position of the nozzle 84 along the length of the feed cylinder shaft 22. For the nozzle 84 closest to the blank leading edge intermediate portion 34 the nozzle outlets 94 extend downwardly from the longitudinal axis 98 at an angle of 20°. This arrangement is illustrated in FIGS. 17 and 19. The corresponding air nozzle 84 on the drive side of the feeding mechanism is also directed downwardly at the same 20° angle, as seen in FIG. 31.

Figure 23:
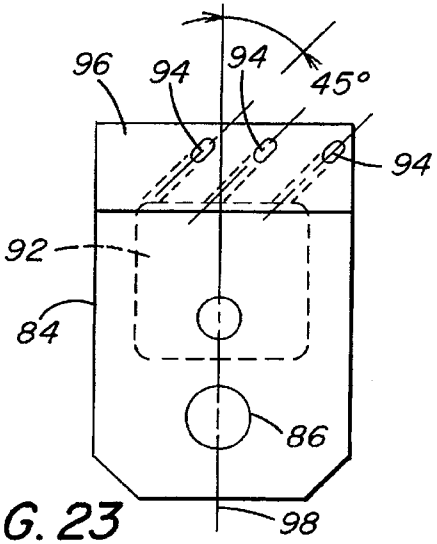
FIGS. 21–23 are plane and elevational views of an air nozzle having air outlets oriented downwardly at a 30° angle.
Figure 26:
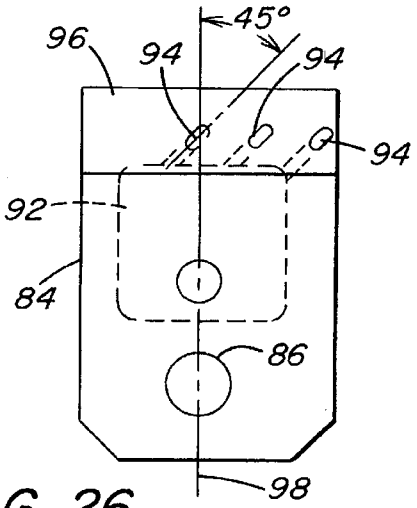
FIGS. 24–26 are plane and elevational views of an air nozzle having air outlets oriented downwardly at a 40° angle.
Figure 22:
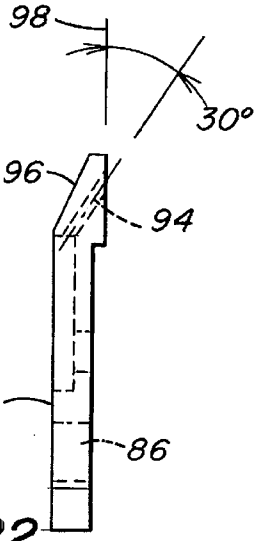
Figure 25:
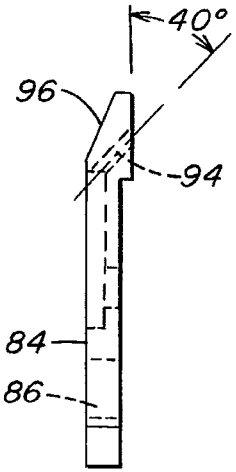
Figure 21:
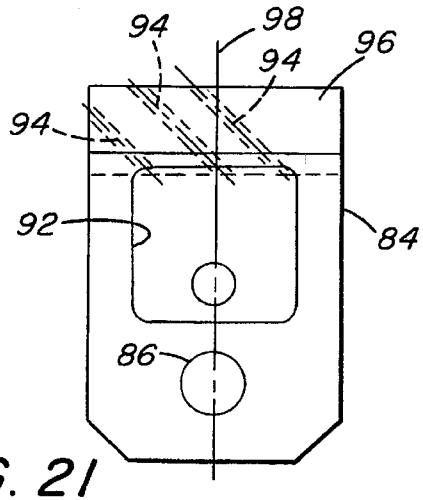
Figure 24:
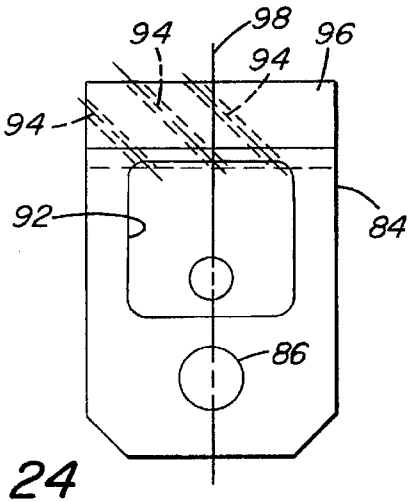
Figure 28:
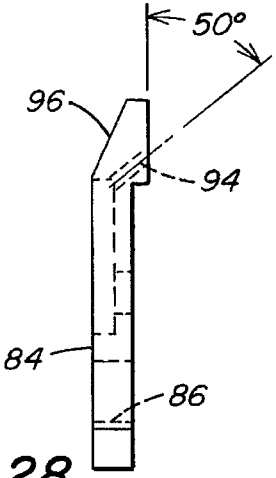
Figure 27:
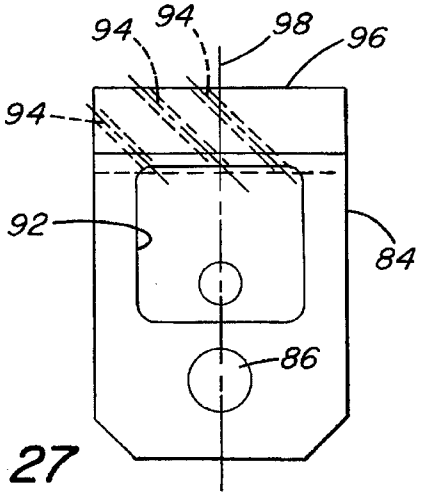

Now referring to FIGS. 21–23 there is illustrated the embodiment shown in FIGS. 18–20 of the air nozzle 84 that is positioned adjacent to the embodiment having a downward angle of 20° for the nozzle outlets 94. The embodiment of the air nozzle shown in FIG. 22 has the nozzle outlets 94 directed downwardly at an angle of 30° from the longitudinal center line 98. FIGS. 24–26 illustrate the embodiment of the air nozzle 84 having the nozzle outlets 94 directed downwardly at an angle of 40° from the longitudinal center line 98. The air nozzle having the 40° angle outlets 94 is positioned adjacent to the nozzle having the 30° angle outlets. Depending upon the length of the blank leading edge lateral portions an outermost air nozzle 84 on the feed cylinder shaft 22 includes nozzle outlets 94 directed downwardly at an angle of 50° as shown in FIGS. 27–29.

It should be understood that the angular displacement of the nozzle outlets 94 is selective and may cover a wide range of positioning to provide the desired directional stream of pressurized air directed upon the lateral portions 36 and 38 of the blank leading edge 33.

With the embodiment of the air manifold 48 illustrated in FIGS. 1 and 2 and in detail in FIGS. 15–32 a wide degree of adjustment is available in positioning the brackets 62–68 at selected locations along the length of the feed cylinder shaft 22 as well as rotating the brackets 62–68 on the shaft 22 to orient the air nozzle outlets 94 to direct a flow of pressurized air in a specific direction upon the blank leading edge 33.

It should also be understood that in view of the constructions of each of the brackets 62–68 the brackets are rotated to a desired radial position and then clamped in the desired position on the shaft 22. This adjustment adds further flexibility to controlling the direction of the pressurized stream upon the blank leading edge 33.

The degrees of adjustment that are available provide almost infinite combinations on the control of the pressurized air stream upon the blank leading edge. The airstream is directed simultaneously downwardly upon the leading edge 33 and laterally outwardly toward the side edges 40 and 42. This assures that the entire leading edge 33 between the side edges 42 and 44 is completely separated from the bottom of the stack prior to its removal, regardless the length or configuration of the leading edge 33.

As shown in FIGS. 3 and 4 the sucker shaft 20 is rotated into engagement with the bottom blank 14 of the stack 12. As feed cylinder 10 rotates the air manifold 48 supplies pressurized air in a sweeping pattern against the entire leading edge 33 of the bottom blank 14 from the intermediate portion 34 outwardly to the blank side edges 40 and 42. Thus, the separation of the blank leading edge 33 is completed before the blank is removed from the stack and transferred to the respective cylinders. The entire leading edge 33 is bent into the opening 26 of the cylinder 10. Then the leading edge 33 is engaged by the pullout segment 30 of plate 28 to complete the separation of the blank 14 before it is removed from the stack.

Now referring to FIGS. 5–10 there is illustrated sequentially the manner in which the pressurized air emanating from within the feed cylinder 10 is directed outwardly through the cylinder peripheral surface 24 upon the blank leading edge 33. The sucker shaft 20 acts first to engage the blank leading edge to initiate separation of the leading edge 33 from the bottom of the stack 12.

Figure 5:
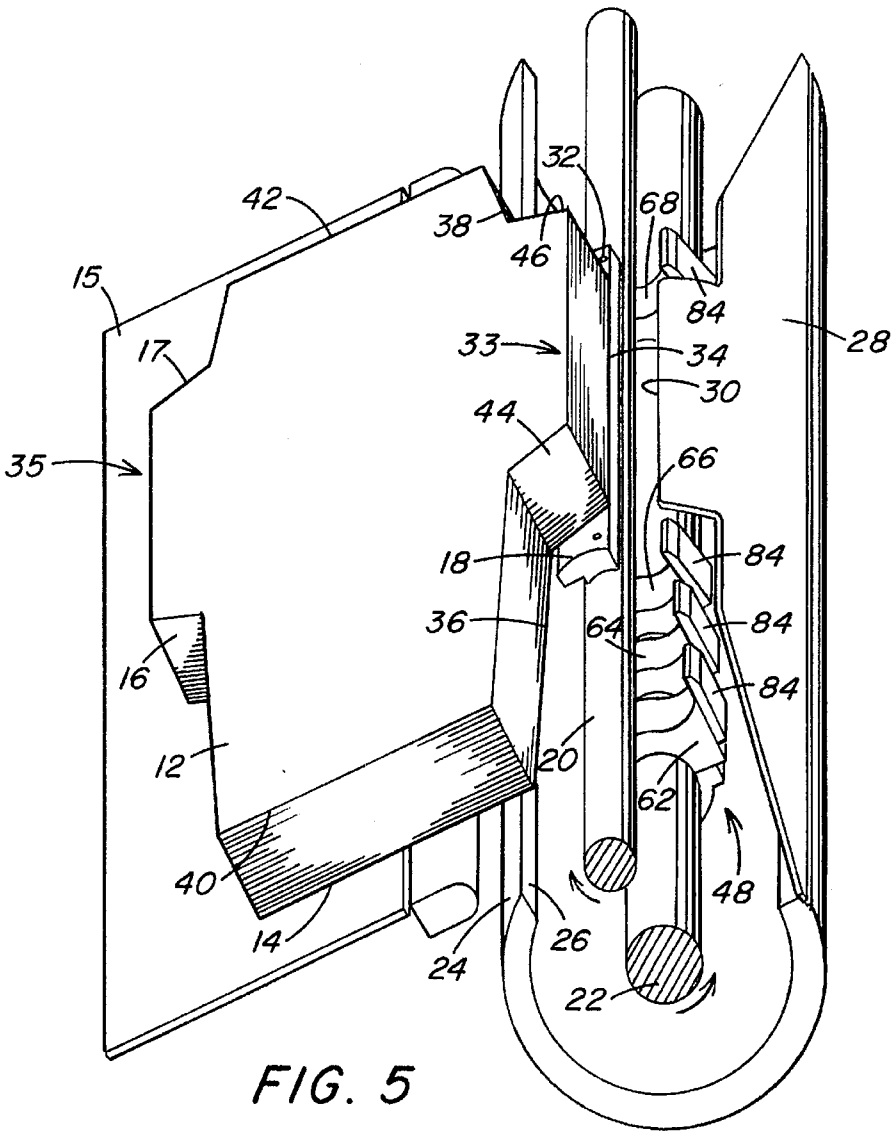
FIG. 5 is a schematic isometric view of the stack of envelope blanks, illustrating the sucker bar advanced into position underlying the intermediate portion of the blank leading edge.

As shown in FIG. 5 the intermediate portion 34 of the bottom blank leading edge is initially engaged by the protuberances 18 of the sucker shaft 20. The blank intermediate portion 34 leads the lateral portions 36 and 38. Therefore, the intermediate portion 34 is engaged and bent downwardly and separated from the stack by the vacuum force prior to the lateral portions 36 and 38 separated by the compressed air flow from within the feed cylinder 10.

Figure 6:
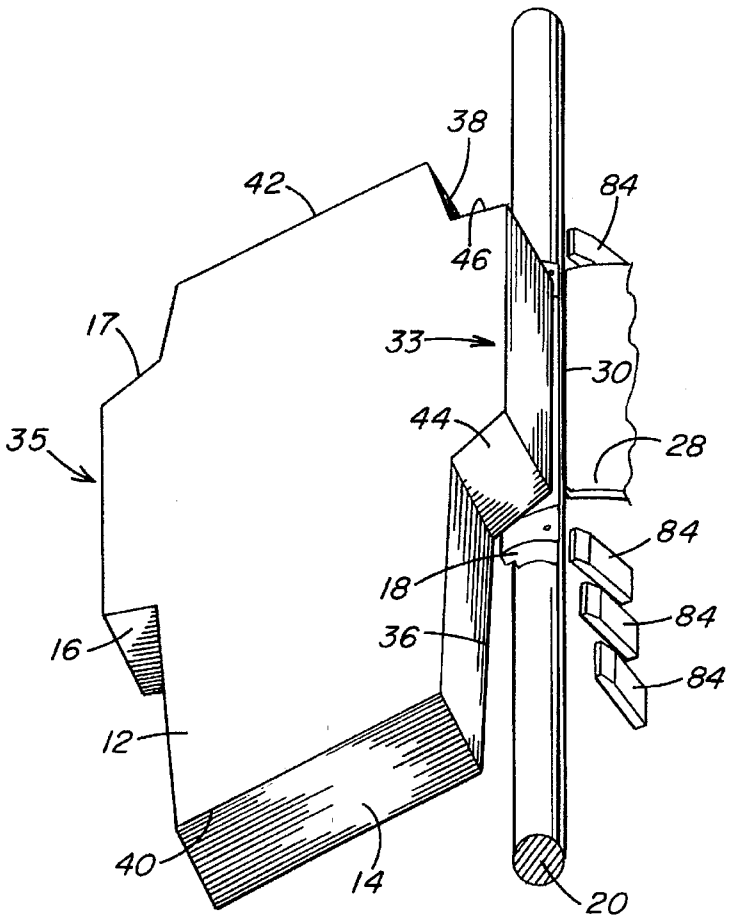
FIG. 6 is a schematic isometric view similar to FIG. 5, illustrating the initial engagement of the intermediate portion of the bottom blank leading edge by the sucker bar.

The initial bending of the blank leading edge intermediate portion is shown in FIG. 6. The downward bending of the bottom blank into the feed cylinder 20 does not take place simultaneously across the full width of the blank leading edge 33. The edge lateral portions 36 and 38 remain fixed as the edge intermediate portion 34 is initially bent. As the sucker shaft 20 continues to rotate the blank intermediate portion 34 further bends downwardly. The air nozzles 84 of the air manifold system 48 are also rotated into position for directing a stream of pressurized air in a sweeping pattern, based on the position of the air nozzles 84, upon the blank lateral portions 36 and 38.

With the leading edge intermediate portion 34 engaged to the sucker shaft 20 by suction, rotation of the shaft 20 creates a gap between the intermediate portion 34 and the undersurface of the bottom of the stack 12. This gap increases as the shafts 20 and 22 rotate, as shown in FIG. 4. As the size of the gap increases the air nozzles 84 are rotated toward the leading edge 33 as shown in FIG. 6.

As schematically illustrated in FIGS. 5–10 the respective air nozzles 84 are supported by the brackets 62–68 in a staggered relationship along the length of the feed cylinder shaft 22. For example the air nozzle closest to the blank leading edge intermediate portion 34 projects forwardly of or leads the remaining air nozzles. Thus, the nozzle 84 closest to the blank intermediate edge portion 34 leads the remaining nozzles. This is accomplished by adjusting the radial position of the brackets 62–68 on the shaft 22 as discussed above. As a result, the pressurized air stream from the air manifold 48 within the cylinder 10 is first directed upon the lateral portions 36 and 38 closest to the blank intermediate portion 34.

Figure 8:
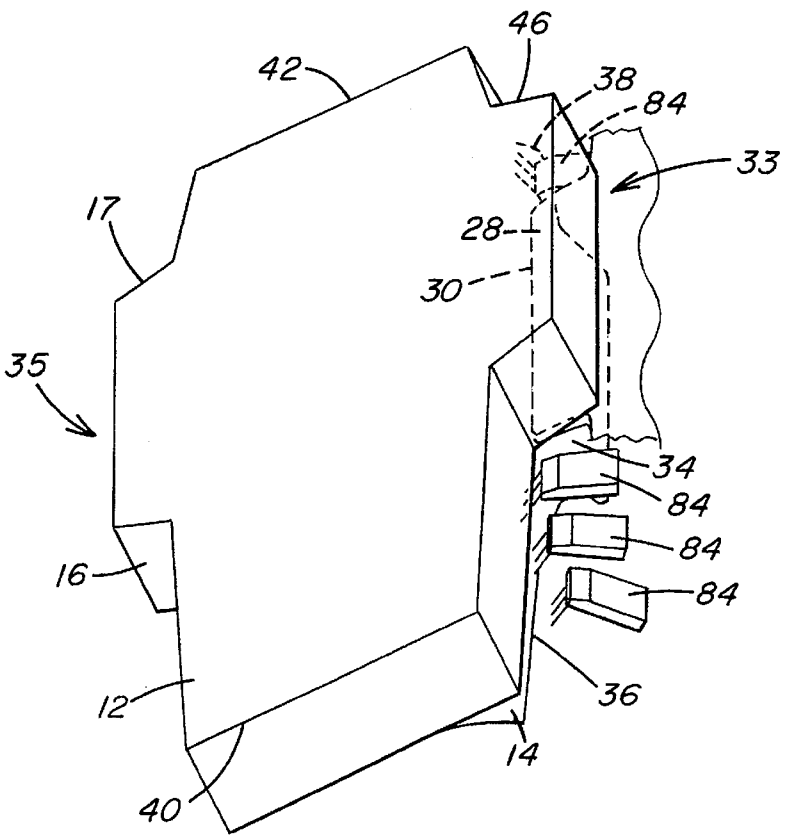
FIG. 8 is a schematic isometric view of the stack of blanks, illustrating the controlled flow of pressurized air upon the lateral portions of the bottom blank leading edge.
Figure 7:
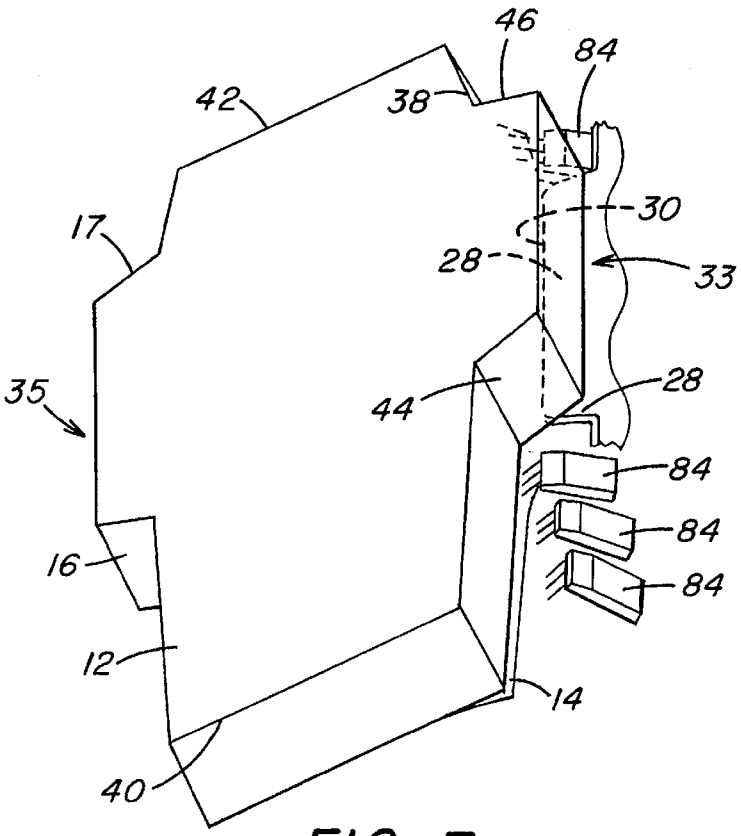
FIG. 7 is a schematic isometric view, illustrating the next sequence in the separation of the bottom blank of the stack where the pressurized air from the nozzles acts upon the lateral portions of the bottom blank leading edge to separate them from the stack.

The effect of staggering the position of the air nozzles 84 on the shaft 22 is shown in FIGS. 7 and 8. As the innermost air nozzle 84 on brackets 66 and 68 acts upon the blank lateral portion 36 adjacent to the recessed portion 44, the lateral portion begins to separate from the bottom of the stack. The forced air flow is directed angularly downward and laterally outward into the gap between the upper surface of the bottom blank 14 and the lower surface of the bottom of the stack 12.

The separation of the edge lateral portion progresses outwardly from the center of the blank as the remaining nozzles 84 are rotated in position to direct a pressurized stream upon the lateral edge portions. Air is supplied to all the nozzle outlets 94 at the same time, but the effects of the air flow are achieved sequentially to create a sweeping air flow from approximately the center of the blank leading edge to the side edges 40 and 42. This sweeping air flow that progresses from the center outwardly occurs due to the staggered arrangement of the air nozzles 84 on the shaft 22. The sweeping effect of pressurized air upon the leading edge assures controlled separation of the lateral portions follow the bending path of the leading edge intermediate portion 34 initiated by rotation of the sucker shaft 20.

The blank leading edge intermediate portion 34 bends first. As the feed cylinder shaft 22 continues to rotate and the gap between the bottom blank 14 and stack 12 increases, the air nozzles 84 are progressively brought into closer proximity to the blank lateral edge portions. The outermost lateral portions 36 and 38 of a blank are not separated from the bottom of the stack before the lateral portions closest to the intermediate portion 34 of the blank leading edge are separated. This assures controlled movement of the blank leading edge to assure that it is completely separated from the stack before the blank is removed from the stack.

Figure 10:
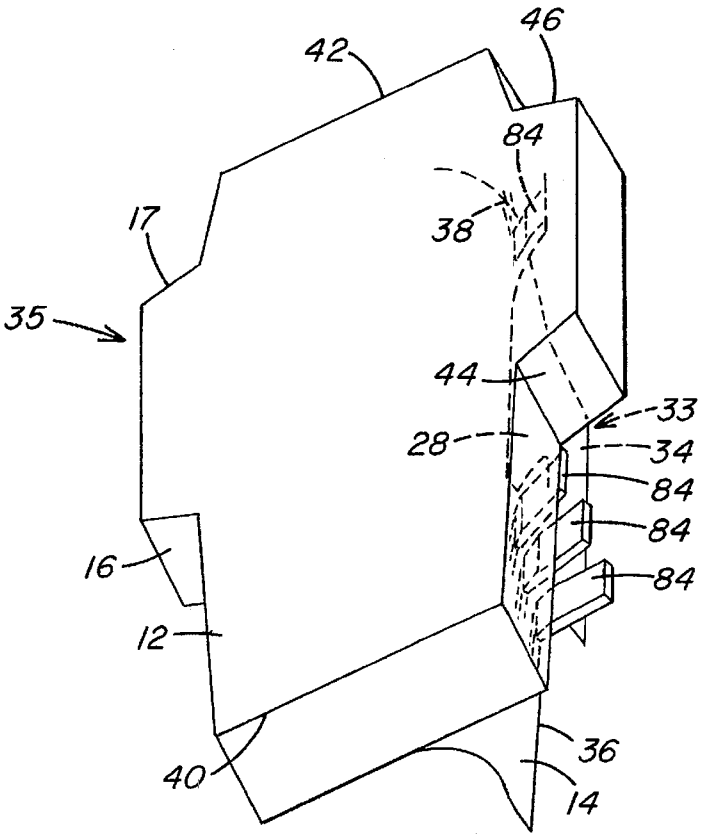
FIG. 10 is a schematic isometric view of the stack of blanks, illustrating the leading edge of the bottom blank completely bent downwardly from the stack to effect evenly controlled separation of the blank from the stack before it is removed from the stack.
Figure 9:
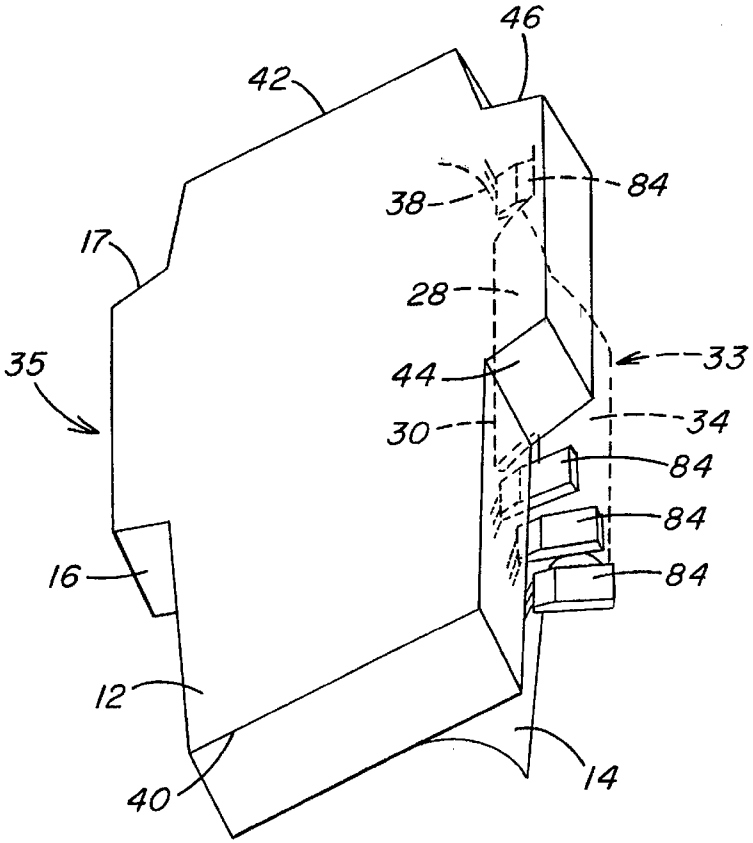
FIG. 9 is a schematic isometric view of the stack of blanks, illustrating the relative position of the air nozzles rotated to bring the pressurized air flow into contact across the full width of the blank leading edge lateral portions.

Once all of the air nozzles 84 have rotated with the shaft 22 to a position to direct a stream of pressurized air upon the entire surface of the blank leading edge 33 the blank is bent into the peripheral opening 26 in the cylinder 10. This position of the blank leading edge 33 is shown in FIGS. 9 and 10. The bending movement of the leading edge 33 is controlled and progresses from the center of the blank outwardly. Once the leading edge 33 enters the cylinder opening 26, the plate 28 at the pullout segment 30 and along the side edges of the plate 28 into the cylinder 10 guides the blank. At this point separation of the blank leading edge 33 from the stack 12 is complete. Prior to removal the blank trailing edge 35 remains fixed as the blank leading edge 33 is bent into contact with the pullout segment 30 of the feed cylinder 10.

Now referring to FIGS. 11–14 there is illustrated further embodiments of sheet feeding mechanisms including the present invention of directing a stream of pressurized air from within the feed cylinder 10 outwardly from the periphery thereof onto the leading edge 33 of the bottom blank 14 in a stack 12. The sheet feeding mechanism shown in FIG. 11 includes a pair of counterrotating support discs 100 and 102 for supporting the front portion of the stack 12 as disclosed in U.S. Pat. No. 3,599,970 which has been incorporated herein by reference.

For purposes of simplicity of illustration in FIG. 11 only a single air nozzle 84 is mounted on the feed cylinder shaft 22 for directing a pressurized stream of air upon the blank leading edge 33 in combination with the suction force applied by the sucker shaft 20 through the protuberances 18. The number of air nozzles 84 mounted along the length of the feed cylinder shaft 22 is determined by the width of the blank leading edge 33 and the contoured configuration. This assures that the bottom blank 14 is not removed from the stack 12 until the leading edge 33 is completely separated from the stack 12 and its direction of movement is controlled to prevent jamming.

Figure 12:
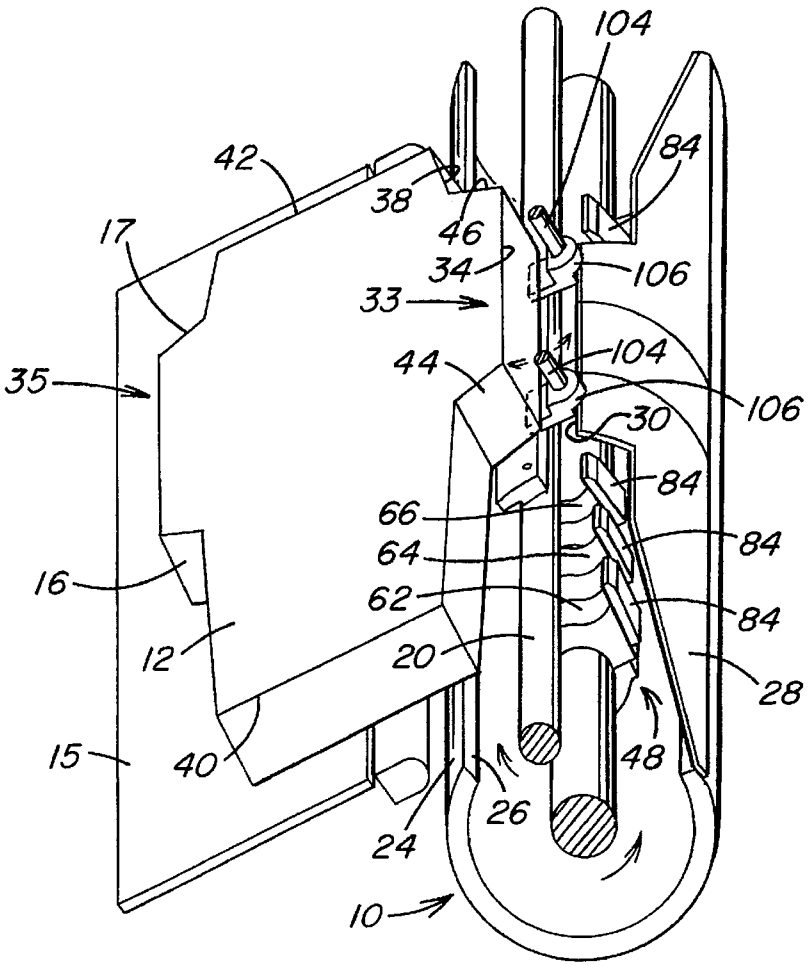
FIG. 12 is a schematic isometric view of another embodiment of the present invention, illustrating a feed cylinder having a pair of reciprocating arms for supporting the front portion of the stack.

The sheet feeding mechanism shown in FIG. 12 is known as a shovel-type feed which utilizes a pair of rocker arms 104 having forwardly extending fingers 106 for supporting the front portion of the stack prior to separation of the bottom blank 14 from the stack 12. As the sucker shaft 20 is rotated in position to engage the intermediate forward edge of the bottom blank, the rocker arms 104 are pivoted rearwardly to provide a clear path for movement of the protuberances 18 into contact with the bottom blank 12. This movement is followed by the pullout segment 30 rotating into contact with the leading edge 33 of the blank.

Now referring to FIGS. 13 and 13A, there is illustrated a further embodiment of a mechanism for feeding blanks 14 from the bottom of a stack 12 that may include either the rotating discs 100 and 102 shown in FIG. 11 or the rocker arms 24 shown in FIG. 12 for supporting the front portion of the stack. The embodiment of the feeding mechanism shown in FIG. 13 includes a compressed air manifold system in which an air manifold 108 is connected by the airline 50 to the valve device 52 as above described and illustrated in FIG. 1. The air manifold 108 includes a plurality of nozzle heads 110 mounted in the edge of the plate 28 that forms the opening 26 in the surface 24 of the feed cylinder 10.

Each nozzle head 110 is connected to the air manifold 108 to receive a flow of pressurized air from the airline 50. Each nozzle head 110 is supported, as shown in FIG. 13A, for swivelable movement on the edge 28 so as to control and adjust the direction of the stream of pressurized air upon the leading edge 33 of the bottom blank 14. As with all the other embodiments of the present invention, the forced airstream emanates from within the feed cylinder 10 and is directly outwardly from the periphery of the cylinder 10 onto the blank leading edge 33. This assures that the pressurized stream contacts the blank leading edge 33 to deflect it downwardly into the cylinder 10. In this manner, the blank is separated from the bottom of the stack before it is removed.

FIG. 14 illustrates an embodiment of the present invention that utilizes a compressed air flow to initiate separation of the bottom blank 14 from a stack 12 in which a feed cylinder generally designated by the numeral 112 includes a segmented configuration formed of a plurality of cutout circular segments 114. Each segment 114 has an identical configuration that includes a cutout portion forming radial fingers 116. Between each segment 114 is positioned a picker or sucker arm 118 mounted on a rotatable shaft 120 movable in the direction indicated by the arrow 122. Each sucker arm 118 rocks in a direction toward and away from the leading edge of the stack 12.

Each sucker arm 118 also includes an outlet 124 positioned below and directed toward the leading edge of the bottom of the stack 12. The rocker arm 118 has hollow configuration and is connected at an opposite end 126 to a hose 128 connected to a vacuum.

When the shaft 120 is rotated to pivot the arms 118, against the lower surface of the bottom blank 14, the vacuum force applied at the outlets 124 engages the leading edge of the bottom blank. This bends the blank downwardly as the rocker arms 118 are pivoted away from the stack 12. To assist in the separation of the blank leading edge 33 from the stack 12, compressed air is applied through the airline 50 from the valve device 52 to a plurality of manifolds 130 positioned in the forward edge of the finger of each segment 114. The manifold 130 in each segment finger includes a plurality of outlets 132 from which a stream of pressurized air is directed outwardly onto a selected portion of the bottom blank lateral portions of leading edge.

For purposes of illustration only, FIG. 14 also includes another device for supplying compressed air against the lateral portions of leading edge 33 of the bottom blank 14. Air hoses 134 extend from the airline 50 between each segment 114. Each hose 134 includes an outlet 136 that projects toward the leading edge of the bottom blank. The air hose 134 is flexible to permit the outlet 136 to be selectively positioned for controlling the direction of the compressed air stream upon the blank leading edge 33, similar to the positioning of the air nozzles 84 shown in FIG. 1. This arrangement also generates a sweeping motion of compressed air upon the blank leading edge 33. The rotating sweeping motion begins adjacent to the blank intermediate portion 34 and progresses outwardly along the blank leading edge lateral portions 36 and 38 to the side edges 40 and 42.

Only a single air hose 134 is shown in position between a pair of cylinder segments 114 in FIG. 14. It should be understood that an air hose is connected to the airline 150 between each segment 114. Also, it should be understood that with the segmented feed cylinder 112 shown in FIG. 14 either the finger mounted air manifolds 130 or the air hoses 134 between the segments 114 are used, but not both on the feed cylinder 112.

With the embodiment shown in FIG. 14, as well as the prior described embodiments of the present invention, the separation of the bottom blank 14 is controlled and completed by the provision of a compressed air flow emanating from within the feed cylinder and directed outwardly from the periphery of the cylinder toward the leading edge 33 of the blank 14. The air flow is not directed externally from above the feed cylinder onto the blank 14 but from within the feed cylinder. This provides a rotating sweep of air to separate the bottom blank 14 from the stack 12. In this manner, the bending of the leading edge 33 is controlled particularly for large blanks having a die cut configuration. The combination of the suction from the sucker shaft 22 and the compressed air flow from the manifold system maintains accurate separation of the bottom blank before it is removed from the stack. This allows high speed feeding of large envelope blanks and the like from a stack.

It also should be understood that the manner of delivery of the compressed air includes many embodiments as illustrated in FIGS. 1 and 11–14 and described above. The delivery of the compressed air is not limited to the provision of the air nozzles 84 and includes any system by which compressed air is conveyed from within the feed cylinder and directed from the periphery of the cylinder in a controlled manner upon the blank leading edge. The positioning of the compressed air outlets from the periphery of the feed cylinder is selective and adjustable in response to the configuration of the blank leading edge. In each instance, however, the movement of the blank leading edge is controlled to bend the leading edge downwardly away from the stack into the opening in the feed cylinder. The bending movement is controlled to achieve separation of the blank leading edge from the stack before the blank is removed from the stack.

According to the provisions of the patent statutes, we have explained the principle, preferred construction, and mode of operation of our invention and have illustrated and described what we now consider to represent its best embodiments. However, it should be understood that within the scope of the appended claims, the invention may be practiced otherwise than as specifically illustrated and described.

We claim:

1. Apparatus for separating blanks from the bottom of a stack comprising, a stack supporting member for retaining in a preselected position a stack of individual blanks, a feed cylinder rotatably positioned beneath a front edge of the stack, said feed cylinder having a peripheral opening, a suction separating mechanism positioned adjacent to said peripheral opening of said feed cylinder, said suction separating mechanism having suction ports extending beyond said peripheral opening of said feed cylinder for applying a suction force on a lower surface of a bottom blank of the stack to deflect an intermediate portion of a leading edge of the bottom blank downwardly into said cylinder peripheral opening during a portion of the rotation of said feed cylinder, means in said feed cylinder for engaging an upper surface of the bottom blank adjacent to the deflected leading edge thereof and further bend the bottom blank leading edge downwardly while a trailing edge of the blank remains fixed relative to the stack, and a source of air under pressure directed from within said feed cylinder outwardly through said peripheral opening into contact with a lateral portion of the leading edge of the bottom blank as said feed cylinder rotates to urge the blank leading edge lateral portion downwardly in a path following the movement of the blank leading edge intermediate portion to provide evenly and controlled separation of the bottom blank from the stack.

2. A method for separating blanks from the bottom of a stack comprising the steps of, supporting a stack of blanks to be fed one by one from the bottom of the stack, rotatably supporting a feed cylinder adjacent to and beneath a front edge of the stack, deflecting an intermediate portion of a front edge of a bottom blank from the stack while maintaining a rearward edge of the bottom blank fixed relative to the stack, bending the blank front edge intermediate portion downwardly into a peripheral opening of the rotating feed cylinder, directing a stream of pressurized air outwardly from within the feed cylinder through the peripheral opening of the feed cylinder into contact with a lateral portion of the blank front edge as the feed cylinder rotates, and downwardly deflecting the front edge lateral portion by the presurized air stream in a path following the movement of the intermediate portion of the blank front edge to obtain complete and evenly controlled separation of the bottom blank from the stack.

3. A feed cylinder for engaging blanks separated from the bottom of a stack of blanks comprising, a cylinder rotatably positioned adjacent to and beneath a front edge of the stack of blanks, said cylinder having a peripheral surface with a longitudinal opening therein, suction devices movably positioned adjacent to said longitudinal opening for applying a suction force at said cylinder peripheral surface upon an intermediate portion of a front edge of a bottom blank of the stack, said suction devices applying a suction force upon the lower surface of the bottom blank to bend the blank front edge intermediate portion downwardly into said opening, and a pressurized stream of air emanating from within said cylinder and directed outwardly through said opening upon a lateral portion of the bottom blank front edge to bend the front edge lateral portion to follow the direction of movement of the front edge intermediate portion for complete and evenly controlled separation of the bottom blank from the stack.

4. Apparatus for separating blanks from the bottom of a stack as set forth in claim 1 in which, said section separating mechanism includes a sucker shaft rotatably mounted in said feed cylinder for rotation in a direction opposite the direction of rotation of said feed cylinder, said sucker shaft having said suction ports extending from said sucker shaft outwardly beyond said feed cylinder peripheral opening, and said suction ports each having a passageway connected to a suction force to apply a vacuum on the surface of said sucker shaft to engage the lower surface of the bottom blank to said sucker shaft.

5. Apparatus for separating blanks from the bottom of a stack as set forth in claim 4 in which, said sucker shaft rotates at a rate greater than the rotational rate of said feed cylinder.

6. Apparatus for separating blanks from the bottom of a stack as set forth in claim 1 in which, said source of air under pressure directed from within said feed cylinder outwardly into contact with the lateral portion of the leading edge of the bottom blank exerts a secondary force acting in combination with the suction force to separate the bottom blank from the stack.

7. Apparatus for separating blanks from the bottom of a stack as set forth in claim 1 which includes, an air manifold mounted in said feed cylinder oppositely of said peripheral opening for rotation with said feed cylinder, a valve device stationarily positioned relative to said feed cylinder for controlling the flow of air from said source of air under pressure, an airline connecting said air manifold to said valve device, and said valve device operable to supply air under pressure through said airline to said air manifold when said feed cylinder is in a preselected angular position relative to the stack for said air manifold to direct the pressurized air onto the lateral portion of the bottom blank leading edge.

8. Apparatus for separating blanks from the bottom of a stack as set forth in claim 7 in which, said air manifold includes a bracket axially mounted within said feed cylinder for rotation with said feed cylinder, and said bracket including a nozzle portion having a plurality of nozzle outlets pitched at a preselected angle to direct a stream of pressurized air in a selected flow pattern onto the bottom blank leading edge.

9. Apparatus for separating blanks from the bottom of a stack as set forth in claim 8 which includes, a driven feed shaft axially mounted within said feed cylinder for transmitting rotation to said feed cylinder, and said bracket adjustably clamped to said feed shaft at a selected position along the length of said feed shaft so that the stream of pressurized air is directed from said nozzle outlets in a selected flow pattern onto the bottom blank leading edge.

10. Apparatus for separating blanks from the bottom of a stack as set forth in claim 9 in which, said bracket is positioned in a selected radical position on said feed shaft to direct the stream of pressurized air from said nozzle outlets upon the lateral portion of the blank leading edge so that the lateral portion follows the direction of movement of the blank leading edge and is engaged on the surface of said sucker shaft and follows the blank leading edge onto the surface of said sucker shaft.

11. Apparatus for separating blanks from the bottom of a stack as set forth in claim 9 in which, said bracket is mounted on said feed shaft within said feed cylinder oppositely of said peripheral opening to direct the stream of pressurized air internally of said feed cylinder outwardly through said opening beyond the peripheral of said feed cylinder.

12. Apparatus for separating blanks from the bottom of a stack as set forth in claim 8 which includes, a plurality of said bracket adjustably clamped to said feed shaft, and said brackets positioned at selected locations along the length of said feed shaft and in selected radial positions on said feed shaft oppositely of the lateral portion of the bottom blank leading edge.

13. Apparatus for separating blanks from the bottom of a stack as set forth in claim 12 in which, said brackets are positioned in selected radial positions on said feed shaft to position said nozzle outlets at selected angular positions so that the stream of pressurized air is directed in a sequential sweeping pattern onto the bottom blank leading edge lateral portion, and said nozzle outlets positioned on said nozzle portion to direct the air stream in the sequential sweeping pattern to progressively deflect downwardly the lateral portion of the bottom blank leading edge from an intermediate portion of the blank leading edge outwardly to a side edge thereof.

14. Apparatus for separating blanks from the bottom of a stack as set forth in claim 8 in which, said nozzle portion includes a longitudinal center line, and said nozzle outlets being first oriented on said nozzle portion to extend at a preselected angle laterally with respect to said longitudinal center line and second pitched downwardly at a preselected angle from said longitudinal center line to simultaneously direct the air stream downwardly upon the bottom blank leading edge and laterally outwardly toward the side edges thereof to assure that the entire blank leading edge between the side edges is completely separated from the bottom of the stack.

15. Apparatus for separating blanks from the bottom of a stack as set forth in claim 14 in which, said feed cylinder includes an operator side and a drive side, a plurality said bracket including a first group positioned adjacent to said operator side and having said nozzle outlets extending laterally at a preselected angle from said longitudinal center line toward said operator side, and a plurality of said bracket including a second group positioned adjacent to said drive side and having said nozzle outlets extending laterally at a preselected angle from said longitudinal center line toward said drive side.

16. A method as set forth in claim 2 which includes, directing the stream of pressurized air in a sequential sweeping pattern onto the bottom blank front edge lateral portion to downwardly deflect the lateral portion beginning at an intermediate portion of the front edge and moving outwardly to a side edge of the blank as the feed cylinder rotates.

17. A method as set forth in claim 2 which includes, directing the stream of pressurized air downwardly at an angle and laterally at an angle upon the bottom blank front edge to assure that the entire front edge between lateral side edges of the bottom blank are completely separated from the bottom of the stack prior to removal of the bottom blank from the stack.

18. A method as set forth in claim 2 which includes, initially bending an intermediate portion of the front edge of the bottom blank from the stack by applying a suction force thereto while the lateral portion of the blank front edge remains fixed, forming a gap between the intermediate portion and an undersurface of the bottom of the stack, and thereafter applying the pressurized stream of air progressively outwardly from the intermediate portion to the lateral portion of the bottom blank into the gap to assure that the blank lateral portion follows the bending path of the front edge intermediate portion.

19. A feed cylinder for engaging blanks separated from the bottom of a stack of blanks as set forth in claim 3 which includes, a plurality of nozzle devices positioned in spaced relation within said cylinder along the length thereof and mounted to rotate with said cylinder, and said nozzle devices including nozzle outlets positioned at a preselected angle to direct the stream of pressurized air in a sweeping pattern outwardly from said cylinder through said opening upon the lateral portion of the bottom blank front edge to separate the bottom blank from the remaining stack.

20. A feed cylinder for engaging blanks separated from the bottom of a stack of blanks as set forth in claim 19 in which, said nozzle devices are mounted within said cylinder for radial and longitudinal movement to position said nozzle outlets at a preselected angle for directing the pressurized air stream upon the bottom blank front edge and laterally outwardly from the front edge intermediate portion to a side edge of the blank to assure that the entire front edge of the blank is separated from the bottom of the stack.

* * * * *

UNITED STATES PATENT AND TRADEMARK OFFICE
CERTIFICATE OF CORRECTION

PATENT NO : 5,642,878

DATED : Jul. 1, 1997

INVENTOR(S) : Eliot S. Smithe, Stephen M. Wagner

It is certified that error appears in the above-identified patent and that said Letters Patent is hereby corrected as shown below:

| | |
|---|---|
| **Column 2, line 43** | **after "is" delete 'swing' and insert -- swung --;** |
| **Column 7, line 13** | **after "illustrating" delete 'in' and insert -- an --;** |
| **Column 9, line 12** | **after "portions is" delete 'connect' and insert --connected --; and** |
| **Column 9, line 20** | **at the beginning of the line, delete 'extent' and insert -- extend --;** |
| **Column 11, line 61** | **at the end of the line, delete 'mounting' and insert -- planar --;** |
| **Column 12, line 7** | **after "nozzle" delete '94' and insert --84--;** |
| **Column 13, line 26** | **at the beginning of the line, delete 'side edges 42 and 44' and insert -- recessed portions 44 and 46 --;** |
| **Column 14, line 43** | **after "portions" delete 'follow' and insert -- along --;** |
| **Column 15, line 43** | **after "arms" delete '24' and insert -- 104 --;** |
| **Column 15, line 54** | **after "the" delete 'edge' and insert -- plate --;** |
| **Column 16, line 13** | **after "The" delete 'rocker' and insert -- sucker --;** |

UNITED STATES PATENT AND TRADEMARK OFFICE
CERTIFICATE OF CORRECTION

PATENT NO : 5,642,878

DATED : Jul. 1, 1997

INVENTOR(S) : Eliot S. Smithe, Stephen M. Wagner

It is certified that error appears in the above-identified patent and that said Letters Patent is hereby corrected as shown below:

| | |
|---|---|
| **Column 16, line 20** | **at the beginning of the line, delete 'rocker' and insert -- sucker --;** |
| **Column 19, line 47** | **after "said" delete 'bracket' and insert -- brackets --;** |
| **Column 20, line 18** | **after "plurality" insert -- of --;** |
| **Column 20, line 18** | **after "said" delete 'bracket' and insert -- brackets --; and** |
| **Column 20, line 23** | **after "said" delete 'bracket' and insert -- brackets --.** |

Signed and Sealed this

Twenty-fourth Day of October, 2000

*Attest:*

Q. TODD DICKINSON

*Attesting Officer*

*Director of Patents and Trademarks*